US010267464B2

(12) United States Patent
Chen

(10) Patent No.: US 10,267,464 B2
(45) Date of Patent: Apr. 23, 2019

(54) TANGLE-RESISTANT DECORATIVE LIGHTING ASSEMBLY

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 15/333,535

(22) Filed: Oct. 25, 2016

(65) Prior Publication Data

US 2017/0114967 A1 Apr. 27, 2017

Related U.S. Application Data

(60) Provisional application No. 62/246,423, filed on Oct. 26, 2015.

(51) Int. Cl.

| | |
|---|---|
| ***F21S 4/10*** | (2016.01) |
| ***F21S 4/15*** | (2016.01) |
| ***F21V 23/00*** | (2015.01) |
| ***F21V 23/06*** | (2006.01) |
| ***H01R 25/00*** | (2006.01) |

(Continued)

(52) U.S. Cl.

CPC ..... *F21S 4/15* (2016.01); *F21V 23/001* (2013.01); *F21V 23/06* (2013.01); *H01R 13/627* (2013.01); *H01R 25/003* (2013.01); *F21S 4/10* (2016.01); *F21W 2121/00* (2013.01); *F21W 2121/006* (2013.01)

(58) Field of Classification Search

CPC .. F21S 4/15; F21S 4/10; F21V 23/001; F21V 23/06; F21W 2121/04; F21W 2121/00

See application file for complete search history.

(56) References Cited

U.S. PATENT DOCUMENTS

| | | | |
|---|---|---|---|
| 398,769 | A | 2/1889 | Currie |
| 2,275,533 | A | 3/1942 | Landy |

(Continued)

FOREIGN PATENT DOCUMENTS

| | | |
|---|---|---|
| CN | 2254143 | 5/1997 |
| CN | 2338598 | 9/1999 |

(Continued)

OTHER PUBLICATIONS

U.S. Appl. No. 15/335,197, filed Oct. 26, 2016, inventor Johnny Chen.

*Primary Examiner* — Peggy A Neils

(74) *Attorney, Agent, or Firm* — Christensen, Fonder, Dardi & Herbert PLLC

(57) ABSTRACT

A decorative lighting assembly comprises a first power wire electrically connected to a first power contact and a second power wire electrically connected to a second power contact. The first power wire and the second power wire cooperate to surround a display area of the decorative lighting assembly. Lamp assemblies are distributed across the display area. The lamp assemblies include a first row of lamp assemblies aligned along a first line, a second row aligned along a second line, a third row aligned along a third line, and a fourth row of lamp aligned along a fourth line. A first cord is disposed along a first zig-zag path connecting the lamp assemblies in the first row with the lamp assemblies in the second row. Intermediate wires are disposed along a second zig-zag path connecting the lamp assemblies in the second row with the lamp assemblies in the third row.

33 Claims, 17 Drawing Sheets

(51) Int. Cl.
*F21W 121/00* (2006.01)
*H01R 13/627* (2006.01)

(56) References Cited

U.S. PATENT DOCUMENTS

| | | | | |
|---|---|---|---|---|
| 3,289,145 | A | 11/1966 | Ruehlemann et al. | |
| 3,302,013 | A | 1/1967 | Richardson | |
| 3,373,397 | A | 3/1968 | Renshaw, Jr. | |
| 3,723,723 | A | 3/1973 | Lerner | |
| 4,870,547 | A | 9/1989 | Crucefix | |
| 5,120,234 | A | 6/1992 | Mergless | |
| 5,150,964 | A | 9/1992 | Tsui | |
| 5,372,525 | A | 12/1994 | Wu et al. | |
| 5,451,842 | A | 9/1995 | Chien | |
| 5,632,550 | A * | 5/1997 | Yeh | H05B 33/0803 362/123 |
| 5,775,802 | A * | 7/1998 | Kuo | F21S 4/10 362/249.01 |
| 5,860,731 | A | 1/1999 | Martinez | |
| 5,915,827 | A | 6/1999 | Wang | |
| 5,932,793 | A * | 8/1999 | Dayton | G01F 1/66 73/23.28 |
| 5,941,628 | A * | 8/1999 | Chang | F21V 19/0005 362/249.01 |
| 5,951,146 | A * | 9/1999 | Lin | F21S 4/10 362/249.13 |
| 5,967,644 | A | 10/1999 | Pan | |
| 6,050,701 | A | 4/2000 | Stone | |
| 6,074,244 | A | 6/2000 | Crum et al. | |
| 6,086,222 | A | 7/2000 | Juba et al. | |
| 6,109,951 | A * | 8/2000 | Huang | F21V 23/06 439/419 |
| 6,126,298 | A | 10/2000 | Wu | |
| 6,152,576 | A | 11/2000 | Mount | |
| 6,179,647 | B1 | 1/2001 | Kinderman | |
| 6,210,016 | B1 | 4/2001 | Prineppi | |
| 6,224,239 | B1 | 5/2001 | Adler | |
| 6,296,374 | B1 | 10/2001 | Ahroni | |
| 6,302,562 | B1 * | 10/2001 | Wu | F21S 4/10 362/249.14 |
| 6,309,087 | B1 | 10/2001 | Huang | |
| 6,319,056 | B1 | 11/2001 | Schunk et al. | |
| 6,354,719 | B1 | 3/2002 | Pan | |
| 6,382,814 | B1 | 5/2002 | Petrocelli | |
| 6,394,624 | B1 | 5/2002 | Hsu | |
| 6,398,387 | B1 | 6/2002 | Wienhold | |
| 6,431,730 | B1 | 8/2002 | Deutsch et al. | |
| 6,474,841 | B1 | 11/2002 | Rahman | |
| 6,575,595 | B1 | 6/2003 | Wu | |
| 6,612,864 | B2 | 9/2003 | Hsu | |
| 6,739,745 | B1 | 5/2004 | Valdes | |
| 6,811,283 | B1 | 11/2004 | Kovacs | |
| 6,830,358 | B2 | 12/2004 | Allen | |
| 6,971,768 | B1 | 12/2005 | Pepito et al. | |
| 7,014,352 | B2 | 3/2006 | Wu | |
| 7,063,442 | B2 | 6/2006 | Sugar | |
| 7,249,866 | B1 | 7/2007 | Tai | |
| 7,351,092 | B2 | 4/2008 | Tseng | |
| 7,481,555 | B2 | 1/2009 | Huang et al. | |
| 7,659,674 | B2 | 2/2010 | Mueller et al. | |
| 9,140,438 | B2 * | 9/2015 | Chen | F21V 23/001 |
| 2003/0206412 | A1 | 11/2003 | Gordon | |
| 2004/0145894 | A1 | 7/2004 | Long | |
| 2005/0254242 | A1 | 11/2005 | Baker | |
| 2006/0164831 | A1 | 7/2006 | Lai | |
| 2008/0049424 | A1 | 2/2008 | Wang | |
| 2009/0027903 | A1 | 1/2009 | Yu | |
| 2009/0256485 | A1 | 10/2009 | Huang et al. | |
| 2009/0322236 | A1 | 12/2009 | Chang et al. | |
| 2012/0086349 | A1 | 4/2012 | Segan | |
| 2013/0033869 | A1 | 2/2013 | Millington | |
| 2015/0211696 | A1 | 7/2015 | Cheng | |

FOREIGN PATENT DOCUMENTS

| | | |
|---|---|---|
| CN | 2340090 | 9/1999 |
| CN | 2365511 | 2/2000 |
| CN | 2415246 | 1/2001 |
| CN | 2432431 | 5/2001 |
| CN | 2432432 | 5/2001 |
| CN | 2435623 | 6/2001 |
| CN | 2460854 | 11/2001 |
| CN | 2490406 | 5/2002 |
| CN | 2714949 | 8/2005 |
| CN | 2883887 | 3/2007 |
| CN | 201129633 | 10/2008 |
| CN | 201155672 | 11/2008 |
| CN | 201204717 | 3/2009 |
| CN | 201288964 | 8/2009 |
| CN | 204708570 | 10/2015 |
| EP | 1172602 | 1/2002 |
| EP | 1424524 | 6/2004 |

* cited by examiner

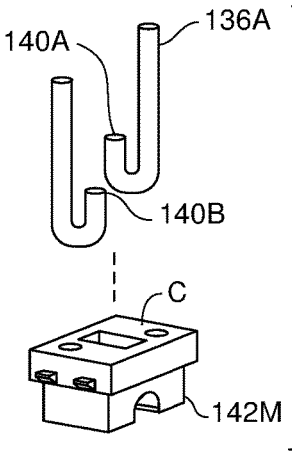
Fig. 6A
Fig. 6B
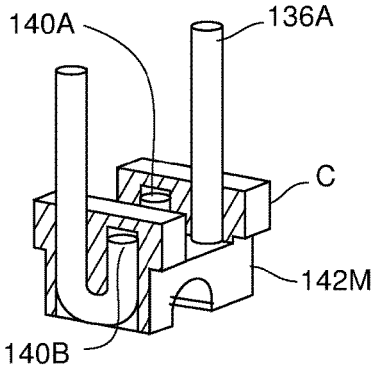
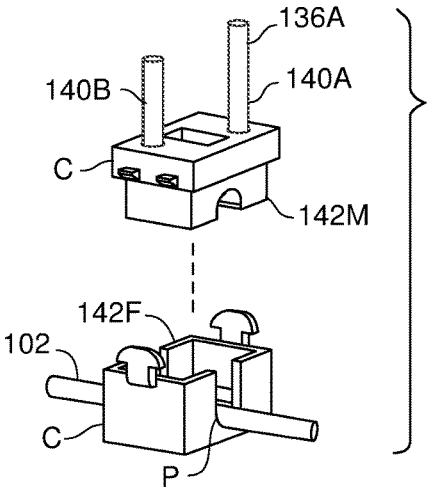
Fig. 6C
Fig. 6D
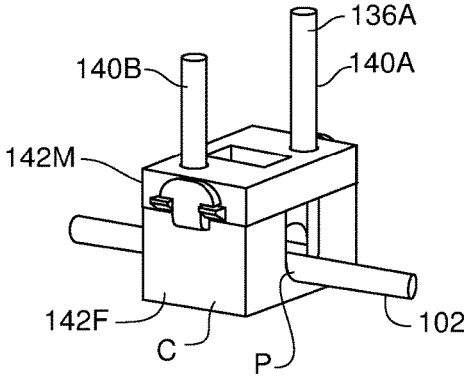

TANGLE-RESISTANT DECORATIVE LIGHTING ASSEMBLY

RELATED APPLICATIONS

The present application claims the benefit of U.S. Provisional Application No. 62/246,423, filed Oct. 26, 2015, entitled TANGLE-RESISTANT DECORATIVE LIGHTING ASSEMBLY, which is incorporated herein by reference in its entirety.

FIELD OF THE DISCLOSURE

The present invention is generally directed to decorative lighting. More specifically, the present invention is directed to decorative lighting assemblies having a net-like structure.

BACKGROUND OF THE INVENTION

Decorative lighting assemblies, and in particular net lights are traditionally assembled using elaborate patterns of interconnected wires and lights to form a particular desired shape or structure. Net lights, for example, often form rectangular or square outlines using zig-zag patterns of conductors powering incandescent or light-emitting diode (LED) lamps. The extensive lengths of wire conductors twisted together to form the desired shape or outline of such decorative assemblies results in a consumer product prone to tangling. Not only does such tangling of wires result in consumer frustration, but the untangling of the wires can result in wires being pulled from their connectors, resulting in potential safety hazards.

Further, from a manufacturing perspective, assembling net-like decorative lighting assemblies to achieve consistent appearances can be challenging.

SUMMARY

A decorative lighting assembly comprises a first power wire electrically connected to a first power contact and a second power wire electrically connected to a second power contact. The first power wire and the second power wire cooperate to surround a display area of the decorative lighting assembly. A plurality of lamp assemblies are distributed across the display area. The plurality of lamp assemblies includes a first row of lamp assemblies aligned along a first line, a second row of lamp assemblies aligned along a second line, a third row of lamp assemblies aligned along a third line, and a fourth row of lamp assemblies aligned along a fourth line. A first cord is disposed along a first zig-zag path connecting the lamp assemblies in the first row with the lamp assemblies in the second row. A plurality of intermediate wires are disposed along a second zig-zag path connecting the lamp assemblies in the second row with the lamp assemblies in the third row. A second cord is disposed along a third zig-zag path connecting the lamp assemblies in the third row with the lamp assemblies in the fourth row.

BRIEF DESCRIPTION OF THE DRAWINGS

The invention can be understood in consideration of the following detailed description of various embodiments of the invention in connection with the accompanying drawings, in which:

FIG. 6A is an exploded perspective view showing portions of a cord and a male portion of a fastener C;

FIG. 6B is an additional perspective view showing the cord and the male portion the fastener shown in FIG. 6A;

FIG. 6C is an exploded perspective view showing the male portion of the fastener and the female portion of the fastener shown in FIG. 6B;

FIG. 6D is an exploded perspective view showing the cord and first power wire of FIG. 6C coupled by the fastener;

Figure 1:
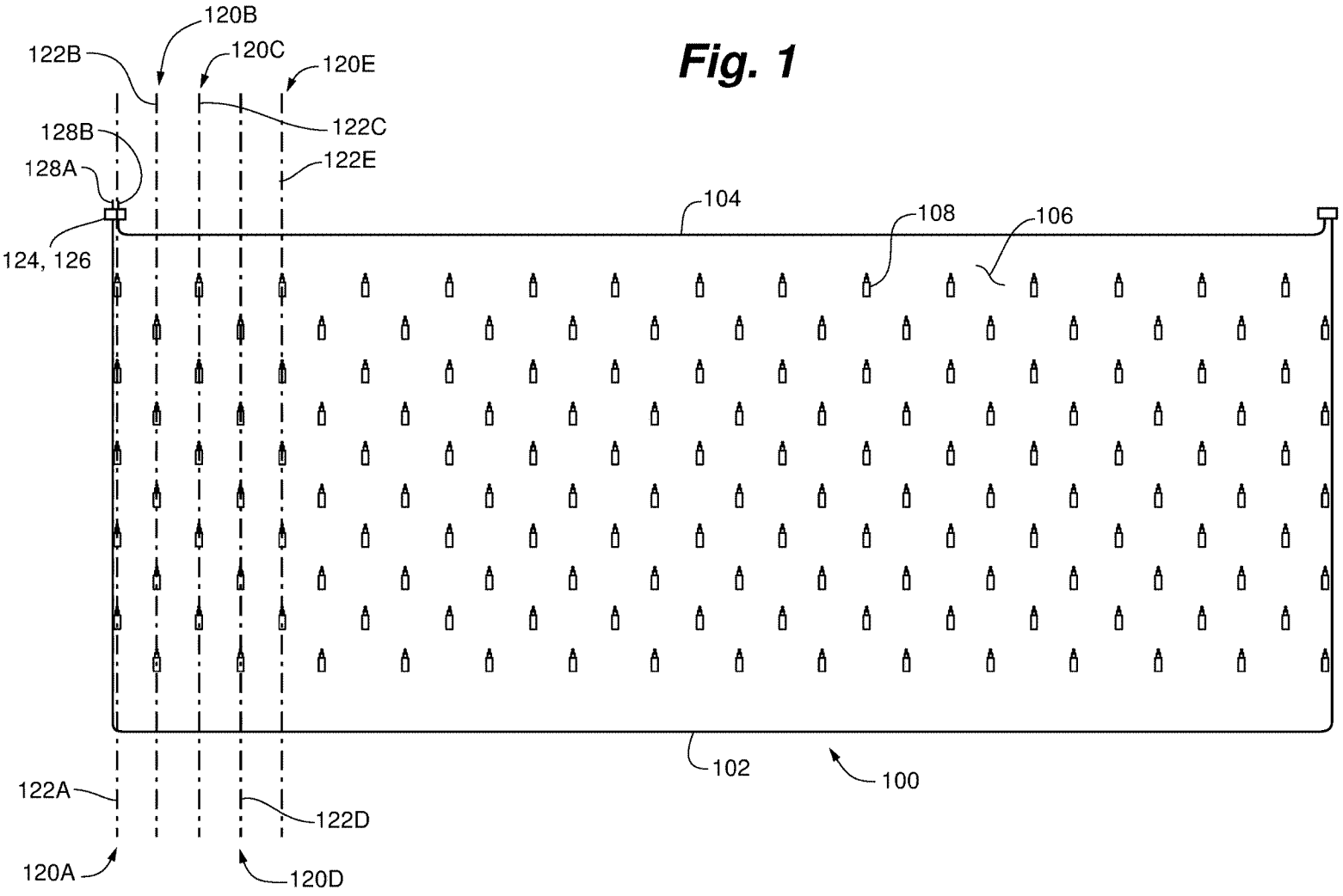
FIG. 1 is a plan view showing an illustrative embodiment of a decorative lighting assembly.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE FIGURES

FIG. 1 is a plan view showing an illustrative embodiment of a decorative lighting assembly 100. Decorative lighting assembly 100 comprises a first power wire 102 and a second power wire 104. In FIG. 1, first power wire 102 and second power wire 104 are cooperating to surround a display area 106 of decorative lighting assembly 100. With reference to FIG. 1 it will be appreciated that decorative lighting assembly 100 includes a plurality of lamp assemblies 108 distributed across display area 106. The plurality of lamp assemblies 108 include a first column 120A of lamp assemblies 108 aligned along a first line 122A, a second column 120B of lamp assemblies 108 aligned along a second line 122B, and a third column 120C of lamp assemblies 108 aligned along a third line 122C.

A plurality of lamp assemblies 108 of decorative lighting assembly 100 may be inter-connected by wires to form one or more electrical circuits. A plurality of lamp assemblies 108 of decorative lighting assembly 100 may be mechanically coupled by cords which provide mechanical support. In some embodiments, the wires and the cords cooperate to form a net-like structure. In the embodiment of FIG. 1, the plurality of lamp assemblies 108 include a fourth column 120D of lamp assemblies 108 aligned along a first line 122D and a fifth column 120E of lamp assemblies aligned along a fifth line 122E.

Decorative lighting assembly 100 of FIG. 1 includes a power plug 124. Power plug 124 may comprise a traditional power plug comprising housing 126, first power terminal 128A and a second power terminal 128B for plugging into an outlet of an external power source, which may be an alternating-current (AC) power source. First power wire 102 is electrically connected to first power terminal 128A of power plug 124. Second power wire 104 is electrically connected to second power terminal 128B of power plug 124. In some embodiments, first power wire 102 and second power wire 104 may comprise a reinforced wire such as the reinforced wire described in issued U.S. Pat. No. 9,243,788, which is herein incorporated by reference in its entirety.

With reference to FIG. 1, it will be appreciated that display area 106 of decorative lighting assembly 100 has a shape generally corresponding to a four-sided polygon. In the embodiment of FIG. 1, the shape of display area generally corresponds to a rectangle having a first long side, a second long side, a first short side, and a second short side. First power wire 102 defines the first short side, the first long side, and the second short side of a rectangle in the embodiment of FIG. 1. Second power wire 104 defines the second long side of a rectangle in the embodiment of FIG. 1.

Figure 2:
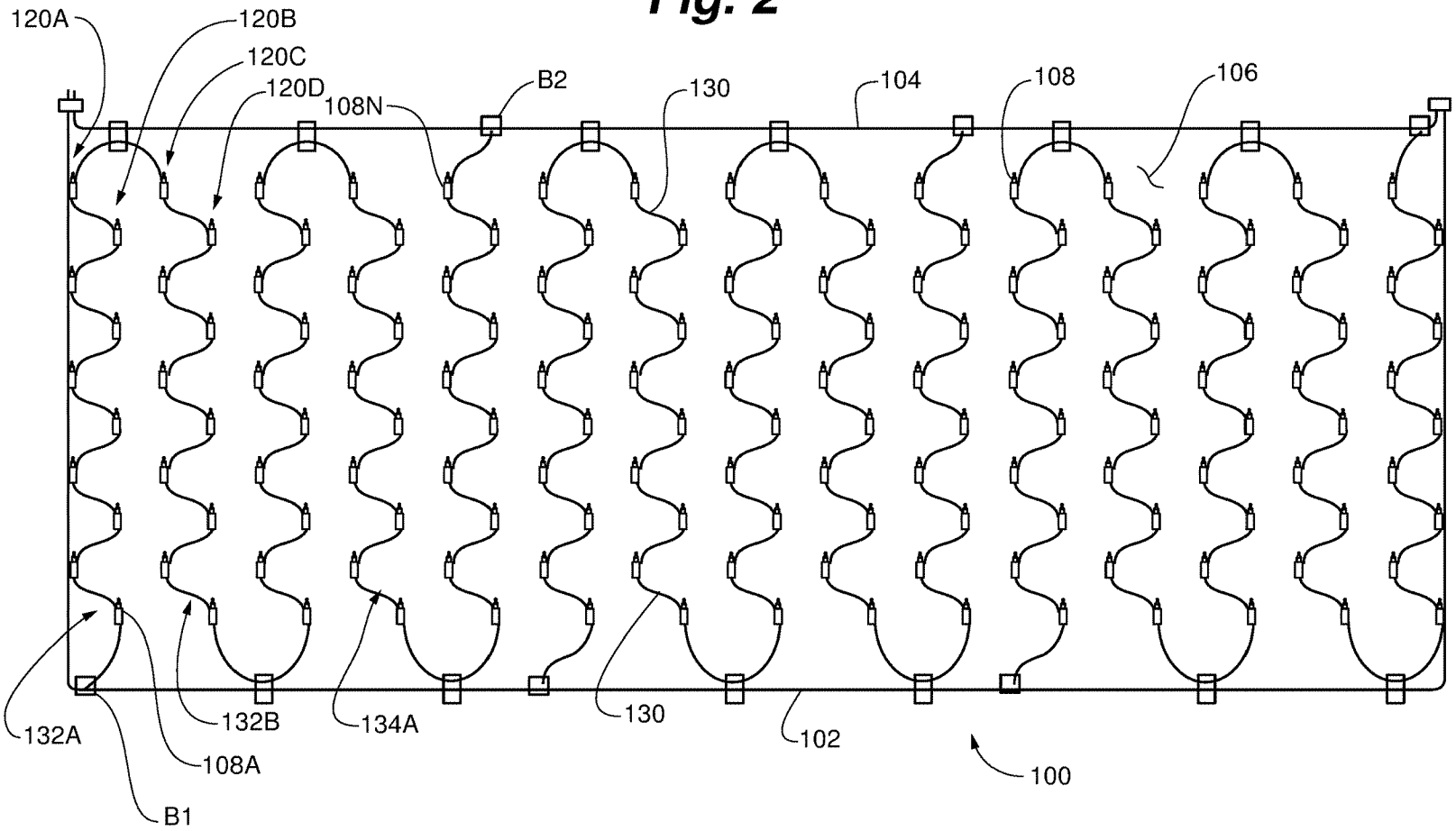
FIG. 2 is a plan view showing an additional illustrative embodiment of the decorative lighting assembly shown in FIG. 1.

FIG. 2 is a plan view showing an additional illustrative embodiment of decorative lighting assembly 100 shown in the previous figure. Decorative lighting assembly 100 comprises a first power wire 102 and a second power wire 104. In FIG. 2, first power wire 102 and second power wire 104 are cooperating to surround a display area 106 of decorative lighting assembly 100. With reference to FIG. 2 it will be appreciated that decorative lighting assembly 100 includes a plurality of lamp assemblies 108 distributed across display area 106. The plurality of lamp assemblies 108 include a first column 120A of lamp assemblies 108, a second column 120B of lamp assemblies 108, a third column 120C of lamp assemblies 108, and a fourth column 120D of lamp assemblies 108.

In the embodiment of FIG. 2, a plurality of intermediate wires 130 are disposed along a first zig-zag path 132A connecting the lamp assemblies in first column 120A with the lamp assemblies in second column 120B. In some embodiments, decorative lighting assembly 100 may include a cord that is disposed along a second zig-zag path connecting the lamp assemblies in second column 120B with the lamp assemblies in third column 120C. In the embodiment of FIG. 2, decorative lighting assembly 100 includes a plurality of intermediate wires 130 that are disposed along a third zig-zag path 132C connecting the lamp assemblies in third column 120C with the lamp assemblies in fourth column 120D. In some embodiments, intermediate wires 130, first power wire 102 and second power wire 104 may comprise a reinforced wire such as the reinforced wire described in issued U.S. Pat. No. 9,243,788, which is herein incorporated by reference in its entirety.

Decorative lighting assembly 100 of FIG. 2, includes a first series circuit 134A comprising a first lamp assembly 108A electrically connected to first power wire 102 at a connector B1 and an nth lamp assembly 108N electrically connected to second power wire 104 at a connector B2. In the embodiment of FIG. 2, a plurality of intermediate lamp assemblies 108 are electrically connected in series between first lamp assembly 108A and nth lamp assembly 108A.

With reference to FIG. 2, it will be appreciated that first series circuit 134 follows a winding path between connector B1 and connector B2 so that the lamp assemblies 108 are distributed across display area 106. In the embodiment of FIG. 2, the winding path of first series circuit 134 includes a plurality of intermediate wires 130 disposed along the first zig-zag path 132A connecting the lamp assemblies in first column 120A with the lamp assemblies 108 in second column 120B. First series circuit 134 also includes the plurality of intermediate wires 130 disposed along third zig-zag path 132C connecting the lamp assemblies 108 in third column 120C with the lamp assemblies 108 in fourth column 120D.

Figure 3:
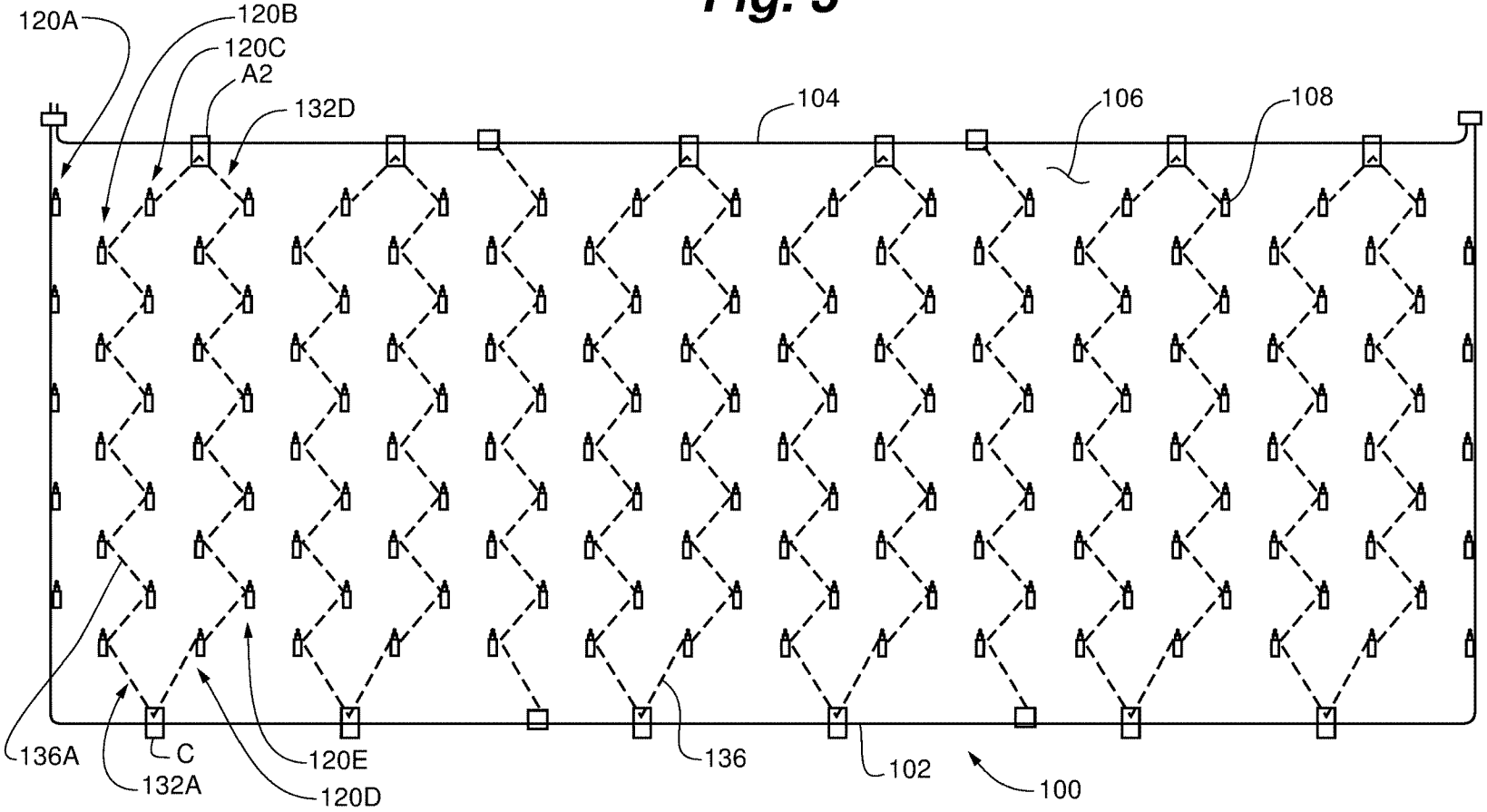
FIG. 3 is a plan view showing an additional illustrative embodiment of the decorative lighting assembly shown in FIG. 1.

FIG. 3 is a plan view showing an additional illustrative embodiment of decorative lighting assembly 100 shown in the previous figure. Decorative lighting assembly 100 comprises a first power wire 102 and a second power wire 104. In FIG. 3, first power wire 102 and second power wire 104 are cooperating to surround a display area 106 of decorative lighting assembly 100. With reference to FIG. 3 it will be appreciated that decorative lighting assembly 100 includes a plurality of lamp assemblies 108 distributed across display area 106. The plurality of lamp assemblies 108 include a first column 120A of lamp assemblies 108, a second column 120B of lamp assemblies 108, a third column 120C of lamp assemblies 108, a fourth column 120 of lamp assemblies 108, and a fifth column 120E of lamp assemblies 108.

In the embodiment of FIG. 3, a plurality of lamp assemblies 108 of decorative lighting assembly 100 are mechanically coupled by cords 136 which provide mechanical support. In some embodiments, a plurality of lamp assemblies 108 of decorative lighting assembly 100 may be inter-connected by wires to form one or more electrical circuits. In some embodiments, the wires and the cords cooperate to form a net-like structure.

Decorative lighting assembly 100 of FIG. 1, includes a cord 136 that is disposed along a second zig-zag path 132A connecting the lamp assemblies in second column 120B with the lamp assemblies in third column 120C. In the embodiment of FIG. 3, cord 136 also extends along a fourth zig-zag path 132D connecting the lamp assemblies in fourth column 120D with the lamp assemblies in fifth column 120E. Cord 136 is illustrated using dashed lines in FIG. 3. In some embodiments, cord 136 may comprise a plurality of cord segments.

In the embodiment of FIG. 3, cord 136A comprises a single cord that extends through both second zig-zag path 132B and the fourth zig-zag path 132D. Decorative lighting assembly 100 of FIG. 3, includes a fastener C that mechanically couples a first end of cord 136A and a second end of cord 136A to first power wire 102. In the embodiment of FIG. 3, first power wire 102 extends through a passageway defined by fastener C.

Decorative lighting assembly 100 of FIG. 3 also includes a bushing A2 that mechanically couples an intermediate portion of cord 136A to second power wire 104. In the embodiment of FIG. 3, cord 136A and second power wire 104 extend through a passageway defined by bushing A2. Also in the embodiment of FIG. 3, cord 136A extends through a passageway defined by a clip of each lamp assembly 108 in second column 120A and each lamp assembly 108 in third column 120C.

Figure 4:
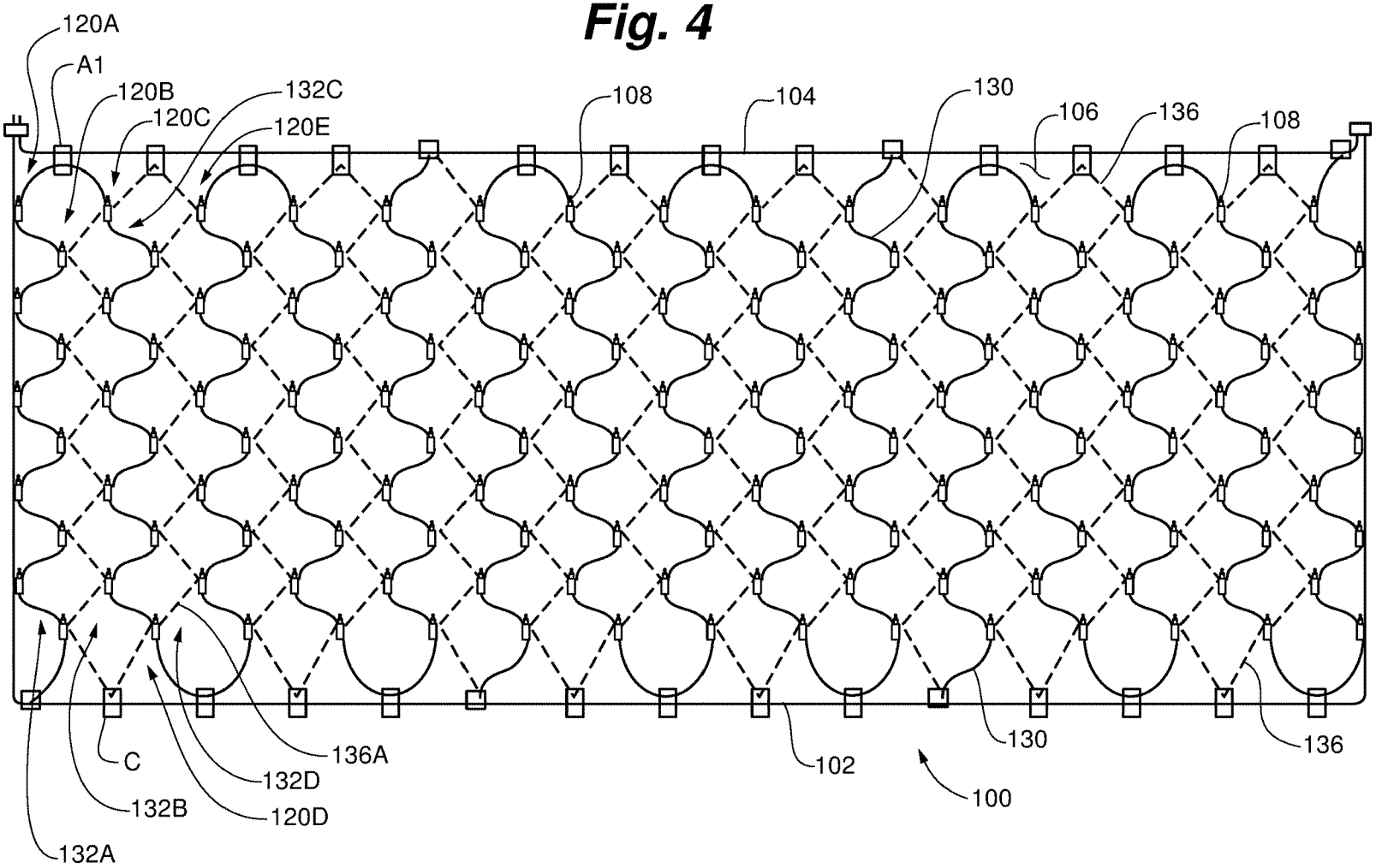
FIG. 4 is a plan view showing an additional illustrative embodiment of the decorative lighting assembly shown in FIG. 1.

FIG. 4 is a plan view showing an additional illustrative embodiment of decorative lighting assembly 100 shown in the previous figure. Decorative lighting assembly 100 comprises a first power wire 102 and a second power wire 104. In FIG. 4, first power wire 102 and second power wire 104 are cooperating to surround a display area 106 of decorative lighting assembly 100. With reference to FIG. 4 it will be appreciated that decorative lighting assembly 100 includes a plurality of lamp assemblies 108 distributed across display area 106. The plurality of lamp assemblies 108 include a first column 120A of lamp assemblies 108, a second column 120B of lamp assemblies 108, a third column 120C of lamp assemblies 108, a fourth column 120 of lamp assemblies 108, and a fifth column 120E of lamp assemblies 108.

In the embodiment of FIG. 4, a plurality of lamp assemblies 108 of decorative lighting assembly 100 are interconnected by intermediate wires 130 to form electrical circuits. Also in the embodiment of FIG. 4, a plurality of lamp assemblies 108 of decorative lighting assembly 100 are mechanically coupled by cords 136 which provide mechanical support. In the embodiment of FIG. 4, the wires and the cords cooperate to form a net-like structure. For purposes of illustration, the cords are illustrated using dashed lines and the wires are illustrated using solid lines in FIG. 4.

In the embodiment of FIG. 4, a plurality of intermediate wires 130 are disposed along a first zig-zag path 132A connecting the lamp assemblies in first column 120A with the lamp assemblies in second column 120B. Also in the embodiment of FIG. 4, decorative lighting assembly 100 includes a cord 136A that extends along a second zig-zag path 132B connecting the lamp assemblies in second column 120B with the lamp assemblies in third column 120C. A plurality of intermediate wires 130 are disposed along a third zig-zag path 132C connecting the lamp assemblies in third column 120C with the lamp assemblies in fourth column 120D. In the embodiment of FIG. 4, cord 136A extends along a fourth zig-zag path 132D connecting the lamp assemblies in fourth column 120D with the lamp assemblies in fifth column 120E. Cord 136A is illustrated using dashed lines in FIG. 4. In some embodiments, cord 136A may comprise a plurality of cord segments.

In the embodiment of FIG. 4, cord 136A comprises a single cord that extends through both second zig-zag path 132B and the fourth zig-zag path 132D. Decorative lighting assembly 100 of FIG. 4, includes a fastener C that mechanically couples a first end of cord 136A and a second end of cord 136A to first power wire 102. In the embodiment of FIG. 4, first power wire 102 extends through a passageway defined by fastener C.

With reference to FIG. 4, it will be appreciated that a top-most intermediate wire extends between a top-most lamp assembly in first column 120A and a top-most lamp assembly in third column 120C. In the embodiment of FIG. 4, a bushing A1 mechanically couples an intermediate portion of the first top-most intermediate wire to second power wire 104. In the embodiment of FIG. 4, the second power wire 104 and the top-most intermediate wire extend through a passageway defined by bushing A1.

In some embodiments of decorative lighting assembly 100, the intermediate wires 130 have a first outer diameter, the cords 136 have a second outer diameter, and the second outer diameter is substantially equal to the first outer diameter so that decorative lighting assembly 100 has a uniform appearance.

In some embodiments of decorative lighting assembly 100, the intermediate wires 130 comprise a plurality of conductor strands and an outer insulating layer adjacent to, and covering, one or more of the conductor strands. The cords 136 may comprise a solid strand. In some embodiments of decorative lighting assembly 100, the insulating layer of the intermediate wires 130 and the solid strand of the cords 136 comprise the same material so that the decorative lighting assembly has a uniform appearance. In some embodiments of decorative lighting assembly 100, the insulating layer of the intermediate wires 130 and the solid strand of the cords 136 are substantially the same color so that the decorative lighting assembly has a uniform appearance.

In some embodiments of decorative lighting assembly 100, the first power wire comprises 18 AWG wire, the second power wire comprises 18 AWG wire, and the intermediate wires comprise 22 AWG wire.

In some embodiments of decorative lighting assembly 100, the first power wire comprises 18 AWG wire, the second power wire comprises 18 AWG wire, and the intermediate wires comprise 22 AWG reinforced wire.

In some embodiments of decorative lighting assembly 100, the first power wire comprises 18 AWG wire, the second power wire comprises 18 AWG wire, and the intermediate wires comprise 25 AWG reinforced wire.

Figure 5A:
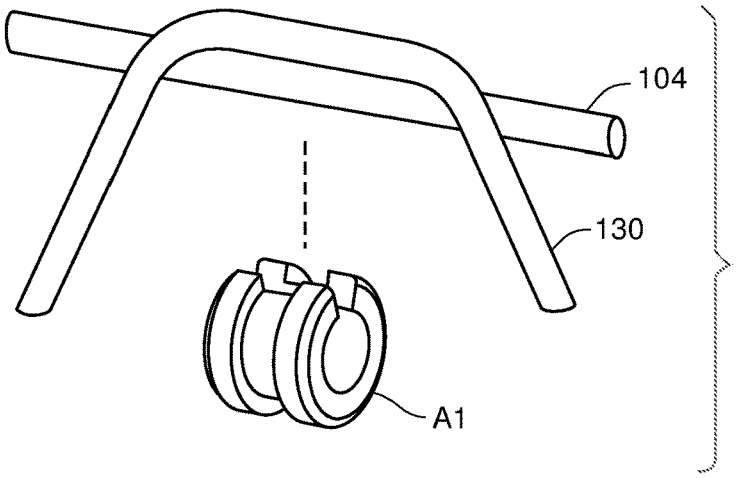
FIG. 5A is an exploded perspective view showing a power wire, an intermediate wire, and a bushing.
Figure 5B:
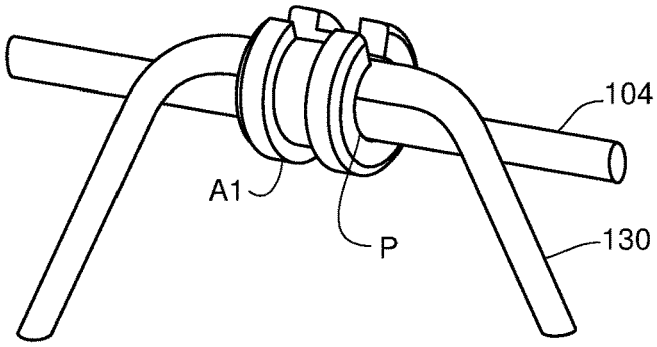
FIG. 5B is a perspective view showing the second power wire, the intermediate wire, and the bushing shown in of FIG. 5A.

FIG. 5A is an exploded perspective view showing a second power wire 104, an intermediate wire 130, and a bushing A1. FIG. 5B is a perspective view showing second power wire 104, intermediate wire 130, and bushing A1 of FIG. 5A in an assembled state. In FIG. 5B, intermediate wire 130 and second power wire 104 can be see extending through a passageway P defined by bushing A1.

Figure 5C:
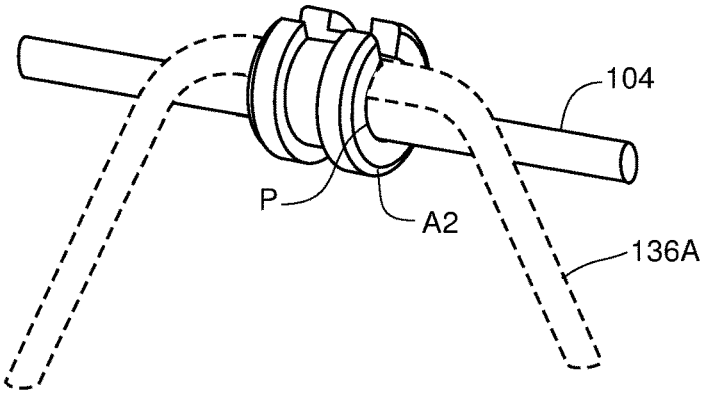
FIG. 5C is a perspective view showing the second power wire, the intermediate wire, and the bushing shown in of FIG. 5A.

FIG. 5C is a perspective view showing a second power wire 104, a cord 136, and a bushing A2. In the embodiment of FIG. 5C, cord 136A and second power wire 104 extend through a passageway P defined by bushing A2.

FIG. 6A is an exploded perspective view showing portions of a cord 136A and a male portion 142M of fastener C. A first end 140A and a second end 140B of cord 136A are visible in FIG. 6A.

FIG. 6B is an additional perspective view showing portions of cord 136A and male portion 142M of fastener C. In the embodiment of FIG. 6B, first end 140A and second end 140B of cord 136A are fixed to male portion 142M of fastener C.

FIG. 6C is an exploded perspective view showing a male portion 142M of fastener C and a female portion 142F of fastener C. In the embodiment of FIG. 6C, first end 140A and second end 140B of cord 136A are fixed to male portion 142M of fastener C. In FIG. 6C, a first power wire 102 can be seen extending through a passageway P defined by female portion 142F of fastener C.

FIG. 6D is an exploded perspective view showing cord 136 coupled to first power wire 102A by fastener C. In the embodiment of FIG. 6D, first end 140A and second end 140B of cord 136A are fixed to male portion 142M of fastener C. In FIG. 6D, first power wire 102 can be seen extending through a passageway P defined by fastener C.

Figure 7B:
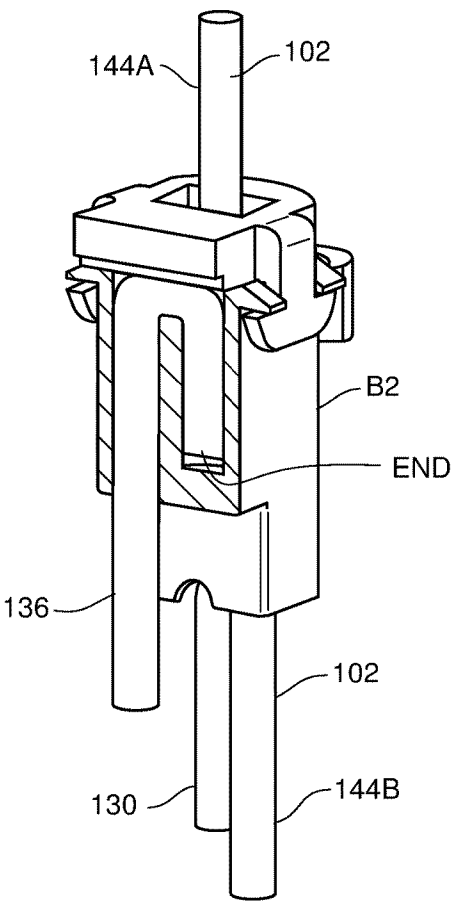
FIG. 7B is a perspective view showing a connector.
Figure 7A:
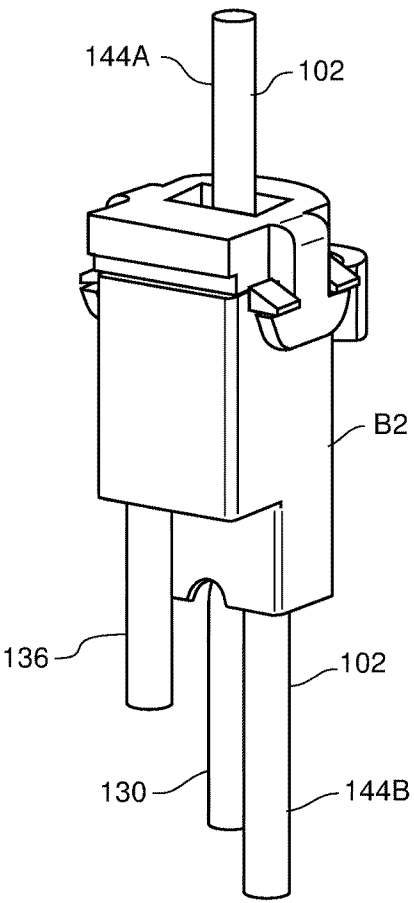
FIG. 7A is a perspective view showing a connector.

FIG. 7A is a perspective view showing a connector B2. In the embodiment of FIG. 7A, a first portion 144A of a power wire 102, a second portion 144B of power wire 102 and an intermediate wire 130 are electrically connected to each other by connector B2. The embodiment of FIG. 7A also includes a cord 136. In the embodiment of FIG. 7A, cord 136, first portion 144A of power wire 102, second portion 144B of power wire 102, and intermediate wire 130 are all mechanically coupled to each other by connector B2.

FIG. 7B is a perspective view showing a connector B2. In the embodiment of FIG. 7B, connector B2 is sectioned so that one end of cord 136 can be seen captured inside connector B2. In the embodiment of FIG. 7B, cord 136, first portion 144A of power wire 102, second portion 144B of power wire 102, and intermediate wire 130 are all mechanically coupled to each other by connector B2. First portion 144A of a power wire 102, a second portion 144B of power wire 102 and an intermediate wire 130 are electrically connected to each other by connector B2 in the embodiment of FIG. 7B.

Figure 8A:
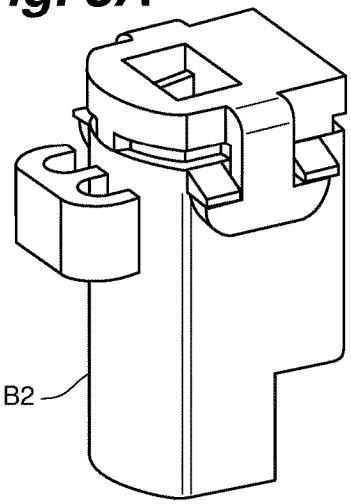
FIG. 8A is a perspective view showing an alternate embodiment of the connector shown in FIG. 7A and FIG. 7B.

FIG. 8A is a perspective view showing an alternate embodiment of connector B2 shown in FIG. 7A and FIG. 7B.

Figure 8B:
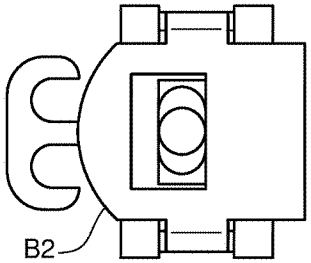
FIG. 8B is a plan view of the connector shown in FIG. 8A.

FIG. 8B is a plan view showing the connector B2 shown in FIG. 8A.

Figure 9A:
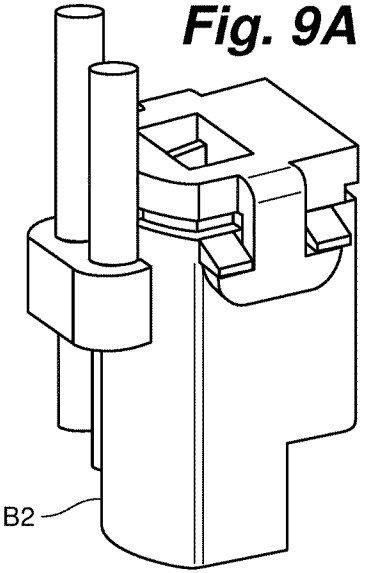
FIG. 9A is a perspective view showing an alternate embodiment of the connector shown in FIG. 7A and FIG. 7B.

FIG. 9A is a perspective view showing an alternate embodiment of connector B2 shown in FIG. 7A and FIG. 7B.

Figure 9B:
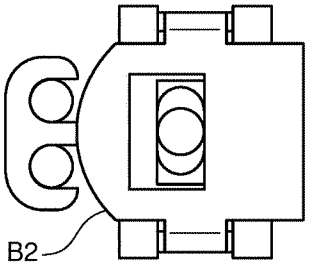
FIG. 9B is a plan view of the connector shown in FIG. 9A.

FIG. 9B is a plan view showing the connector B2 shown in FIG. 9A.

Figure 10D:
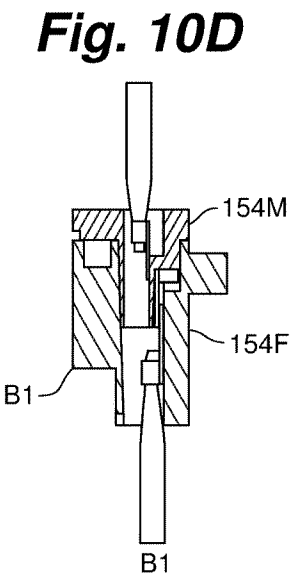
FIG. 10D is a section view further illustrating the male portion of the connector and the female portion of the connector shown in FIG. 10B.
Figure 10C:
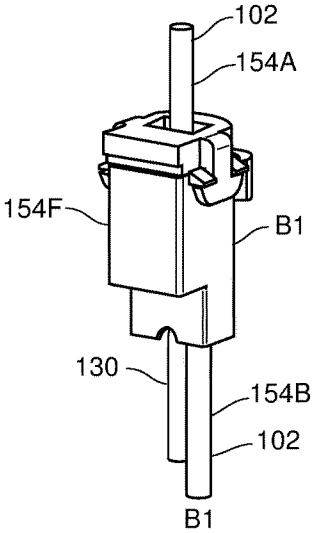
FIG. 10C is an assembled perspective view showing the male portion of the connector and the female portion of the connector shown in FIG. 10B.
Figure 10B:
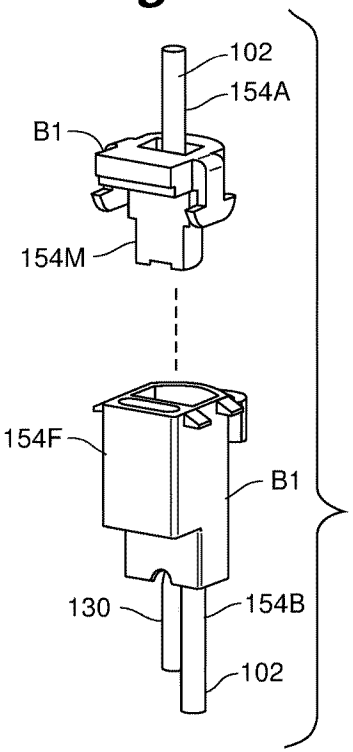
FIG. 10B is a partially assembled perspective view showing the male portion of the connector and the female portion of the connector shown in FIG. 10B.
Figure 10A:
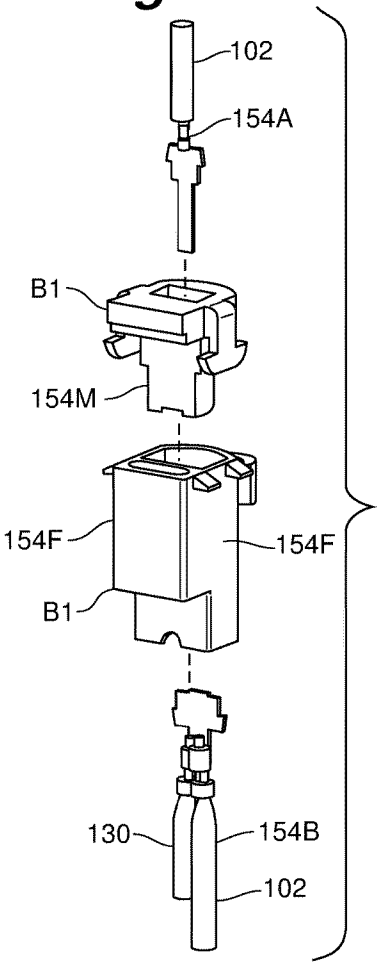
FIG. 10A is an exploded perspective view showing a male portion of a connector and a female portion of the connector, a first portion of a power wire, a second portion of the power wire and an intermediate wire.

FIG. 10A is an exploded perspective view showing a male portion 154M of connector B1 and a female portion 154F of connector B1. A first portion 154A of a power wire 102, a second portion 154B of power wire 102 and an intermediate wire 130 are all illustrated in the exploded view of FIG. 10A.

FIG. 10B is a partially assembled perspective view showing male portion 154M of connector B1 and female portion 154F of connector B1. In the embodiment of FIG. 10B, first portion 154A of power wire 102 has been inserted into male portion 154M of connector B1. Also in the embodiment of FIG. 10B, a second portion 154B of power wire 102 and an intermediate wire 130 have been inserted into female portion 154F of connector B1.

FIG. 10C is an assembled perspective view showing a male portion 154M of connector B1 and a female portion 154F of connector B1. In the embodiment of FIG. 10C, male portion 154M of connector B1 has been inserted into female portion 154F of connector B1. First portion 154A of power wire 102, second portion 154B of power wire 102 and intermediate wire 130 all are electrically connected to each other by connector B2 in the embodiment of FIG. 10C. First portion 154A of power wire 102, second portion 154B of power wire 102, and intermediate wire 130 are also mechanically coupled to each other by connector B2 in the embodiment of FIG. 10C.

FIG. 10D is a section view further illustrating male portion 154M of connector B1 and female portion 154F of connector B1.

Figure 11:
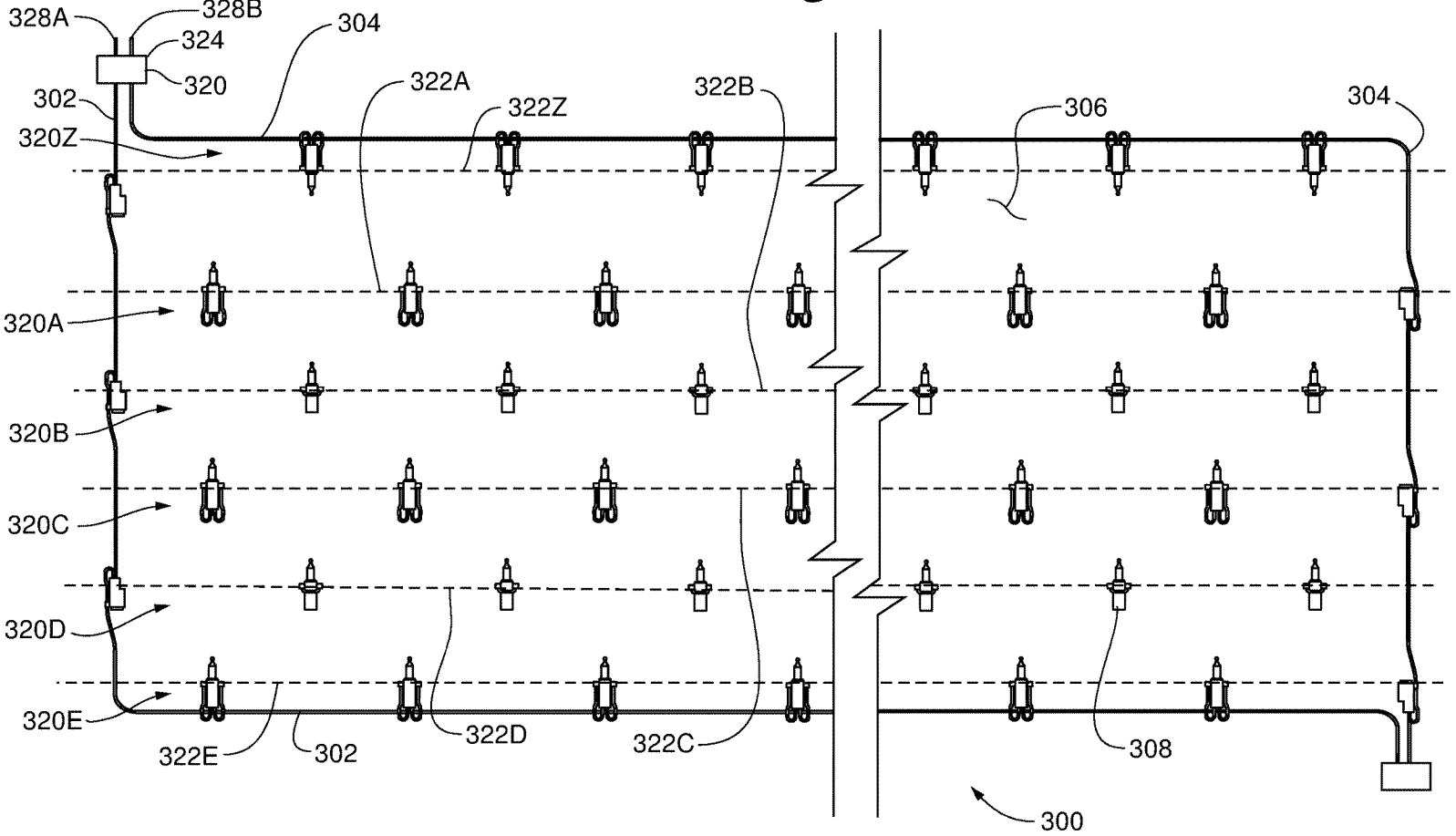
FIG. 11 is a plan view showing an illustrative embodiment of a decorative lighting assembly.

FIG. 11 is a plan view showing an illustrative embodiment of a decorative lighting assembly 300. Decorative lighting assembly 300 comprises a first power wire 302 and a second power wire 304. In FIG. 11, first power wire 302 and second power wire 304 are cooperating to surround a display area 306 of decorative lighting assembly 300. With reference to FIG. 11 it will be appreciated that decorative lighting assembly 300 includes a plurality of lamp assemblies 308 distributed across display area 306. The plurality of lamp assemblies 308 include a first row 320A of lamp assemblies 308 aligned along a first line 322A, a second row 320B of lamp assemblies 308 aligned along a second line 322B, and a third row 320C of lamp assemblies 308 aligned along a third line 322C.

A plurality of lamp assemblies 308 of decorative lighting assembly 300 may be inter-connected by wires to form one or more electrical circuits. A plurality of lamp assemblies 308 of decorative lighting assembly 300 may be mechanically coupled by cords which provide mechanical support. In some embodiments, the wires and the cords cooperate to form a net-like structure. In the embodiment of FIG. 11, the plurality of lamp assemblies 308 include a fourth row 320D of lamp assemblies 308 aligned along a first line 322D and a fifth row 320E of lamp assemblies 308 aligned along a fifth line 322E. The decorative lighting assembly 300 also includes a zeroth row 320Z of lamp assemblies 308 aligned along a zeroth line 322Z in the embodiment of FIG. 11.

Decorative lighting assembly 300 of FIG. 11 includes a power plug 324. Power plug 324 may comprise a traditional power plug comprising housing 326, first power terminal 328A and a second power terminal 328B for plugging into an outlet of an external power source, which may be an alternating-current (AC) power source. First power wire 302 is electrically connected to first power terminal 328A of power plug 324. Second power wire 304 is electrically connected to second power terminal 328B of power plug 324. In some embodiments, first power wire 302 and second power wire 304 may comprise a reinforced wire such as the reinforced wire described in issued U.S. Pat. No. 9,243,788, which is herein incorporated by reference in its entirety.

With reference to FIG. 11, it will be appreciated that display area 306 of decorative lighting assembly 300 has a shape generally corresponding to a four-sided polygon. In the embodiment of FIG. 11, the shape of display area generally corresponds to a rectangle having a first long side, a second long side, a first short side, and a second short side. First power wire 302 defines the first short side and the first long side of a rectangle in the embodiment of FIG. 11. Second power wire 304 defines the second short side and the second long side of a rectangle in the embodiment of FIG. 11.

Figure 12:
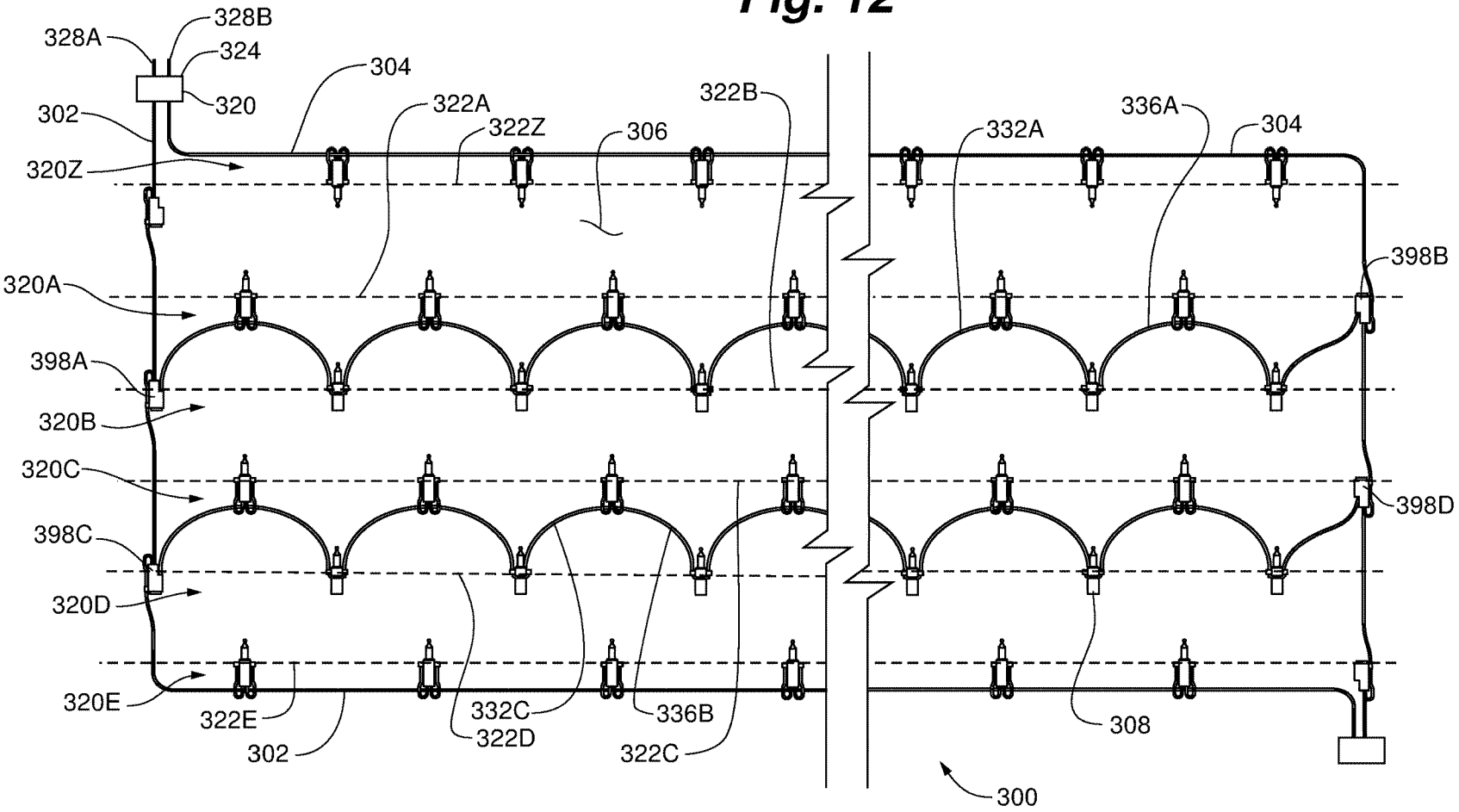
FIG. 12 is a plan view showing an additional illustrative embodiment of the decorative lighting assembly 300 shown in FIG. 11.

FIG. 12 is a plan view showing an additional illustrative embodiment of decorative lighting assembly 300 shown in the previous figure. Decorative lighting assembly 300 comprises a first power wire 302 and a second power wire 304. In FIG. 12, first power wire 302 and second power wire 304 are cooperating to surround a display area 306 of decorative lighting assembly 300. With reference to FIG. 12 it will be appreciated that decorative lighting assembly 300 includes a plurality of lamp assemblies 308 distributed across display area 306. The plurality of lamp assemblies 308 include a first row 320A of lamp assemblies 308, a second row 320B of lamp assemblies 308, a third row 320C of lamp assemblies 308, a fourth row 320 of lamp assemblies 308, and a fifth row 320E of lamp assemblies 308.

In the embodiment of FIG. 12, a plurality of lamp assemblies 308 of decorative lighting assembly 300 are mechanically coupled by cords 336 which provide mechanical support. In some embodiments, a plurality of lamp assemblies 308 of decorative lighting assembly 300 may be inter-connected by wires to form one or more electrical circuits. In some embodiments, the wires and the cords cooperate to form a net-like structure.

In the embodiment of FIG. 12, a first cord 336A is disposed along a first zig-zag path 332A mechanically coupling the lamp assemblies 308 in the first row 320A with the lamp assemblies 308 in the second row 320B. A second cord 336B is disposed along a third zig-zag path 332C mechanically coupling the lamp assemblies 308 in the third row 320C with the lamp assemblies in the fourth row 320D in the embodiment of FIG. 12. In some embodiments, each cord 336 comprises a plurality of cord segments.

In the embodiment of FIG. 12, a first connector 398A mechanically couples a first end of a first cord 336A to the first power wire 304 and a second connector 398B mechanically couples a second end of the first cord 336A to the second power wire 306. A third connector 398C mechanically couples a first end of the second cord 336B to the first power wire 304 and a fourth connector 398D mechanically couples a second end of the second cord 336B to the second power wire 306 in the embodiment of FIG. 12.

Figure 13:
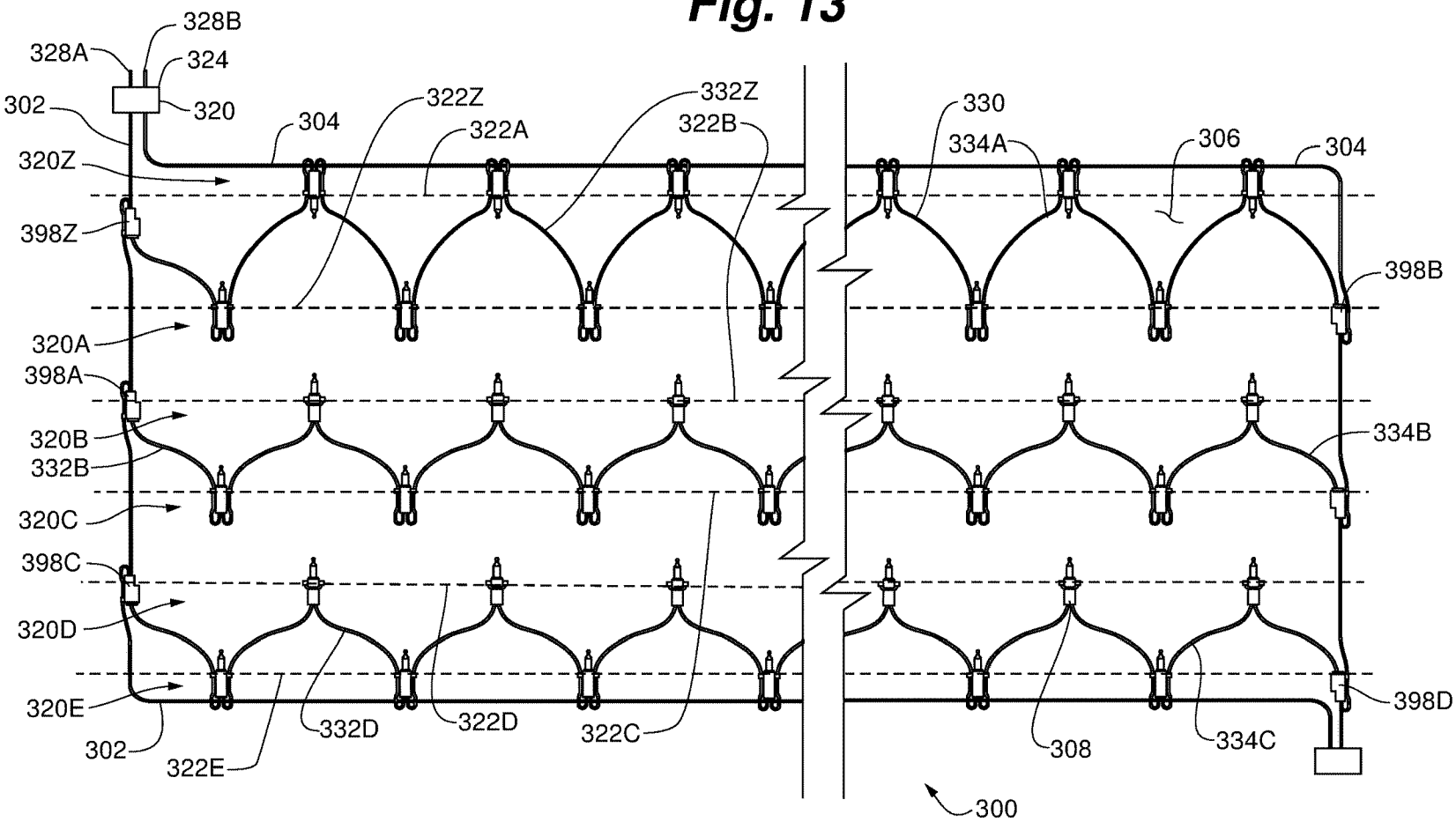
FIG. 13 is a plan view showing an additional illustrative embodiment of decorative lighting assembly 300 shown in FIGS. 11 and 12.

FIG. 13 is a plan view showing an additional illustrative embodiment of decorative lighting assembly 300 shown in the previous figure. Decorative lighting assembly 300 comprises a first power wire 302 and a second power wire 304. In FIG. 13, first power wire 302 and second power wire 304 are cooperating to surround a display area 306 of decorative lighting assembly 300. With reference to FIG. 13 it will be appreciated that decorative lighting assembly 300 includes a plurality of lamp assemblies 308 distributed across display area 306. The plurality of lamp assemblies 308 include a first row 320A of lamp assemblies 308, a second row 320B of lamp assemblies 308, a third row 320C of lamp assemblies 308, and a fourth row 320D of lamp assemblies 308.

In the embodiment of FIG. 13, a plurality of intermediate wires 330 are disposed along a zeroth zig-zag path 332Z connecting the lamp assemblies 308 in the zeroth row 320Z with the lamp assemblies 308 in the first row 320A. Also in the embodiment of FIG. 13, a plurality of intermediate wires 330 are disposed along a second zig-zag path 332B connecting the lamp assemblies 308 in the second row 320B with the lamp assemblies 308 in the third row 320C. A plurality of intermediate wires 330 disposed along a fourth zig-zag path 332D connecting the lamp assemblies 308 in the fourth row 320D with the lamp assemblies 308 in the fifth row 320E in the embodiment of FIG. 13.

In some embodiments, intermediate wires 330, first power wire 302 and second power wire 304 may comprise a reinforced wire such as the reinforced wire described in issued U.S. Pat. No. 9,243,788, which is herein incorporated by reference in its entirety.

Decorative lighting assembly 300 of FIG. 13, includes a first series circuit 334A comprising a plurality of lamp assemblies 308 and intermediate wires 330 connected between the first power wire 304 and second power wire 306. In the embodiment of FIG. 13, the first series circuit 334A includes a plurality of intermediate wires 330 disposed along a zeroth zig-zag path 332Z connecting the lamp assemblies 308 in the zeroth row 320Z with the lamp assemblies 308 in the first row 320A. In the embodiment of FIG. 13, a zeroth connector 398Z electrically connects a first end of the first series circuit 334A to the first power wire 304 and a second connector 398B electrically connects a second end of the first series circuit 334A to the second power wire 306.

Decorative lighting assembly 300 of FIG. 13, also includes a second series circuit 334B comprising a plurality of lamp assemblies 308 and intermediate wires 330 connected between the first power wire 304 and second power wire 306. A third series circuit 334C of decorative lighting assembly 300 can also be seen in FIG. 13. The third series circuit 334C comprises a plurality of lamp assemblies 308 and intermediate wires 330 connected between the first power wire 304 and second power wire 306.

In the embodiment of FIG. 13, the second series circuit 334B includes a plurality of intermediate wires 330 disposed along the second zig-zag path 332B connecting the lamp assemblies 308 in the second row 320B with the lamp assemblies 308 in the third row 320C. In the embodiment of FIG. 13, the third series circuit 334C includes a plurality of intermediate wires 330 disposed along the fourth zig-zag path 332D connecting the lamp assemblies 308 in the fourth row 320D with the lamp assemblies 308 in the fifth row 320E. In the embodiment of FIG. 13, a first connector 398A electrically connects a first end of the second series circuit 334B to the first power wire 304 and a fourth connector 398D electrically connects a second end of the second series circuit 334B to the second power wire 306. In the embodiment of FIG. 13, a third connector 398C electrically connects a first end of the third series circuit 334B to the first power wire 304 and a fifth connector 398E electrically connects a second end of the third series circuit 334B to the second power wire 306.

Figure 14:
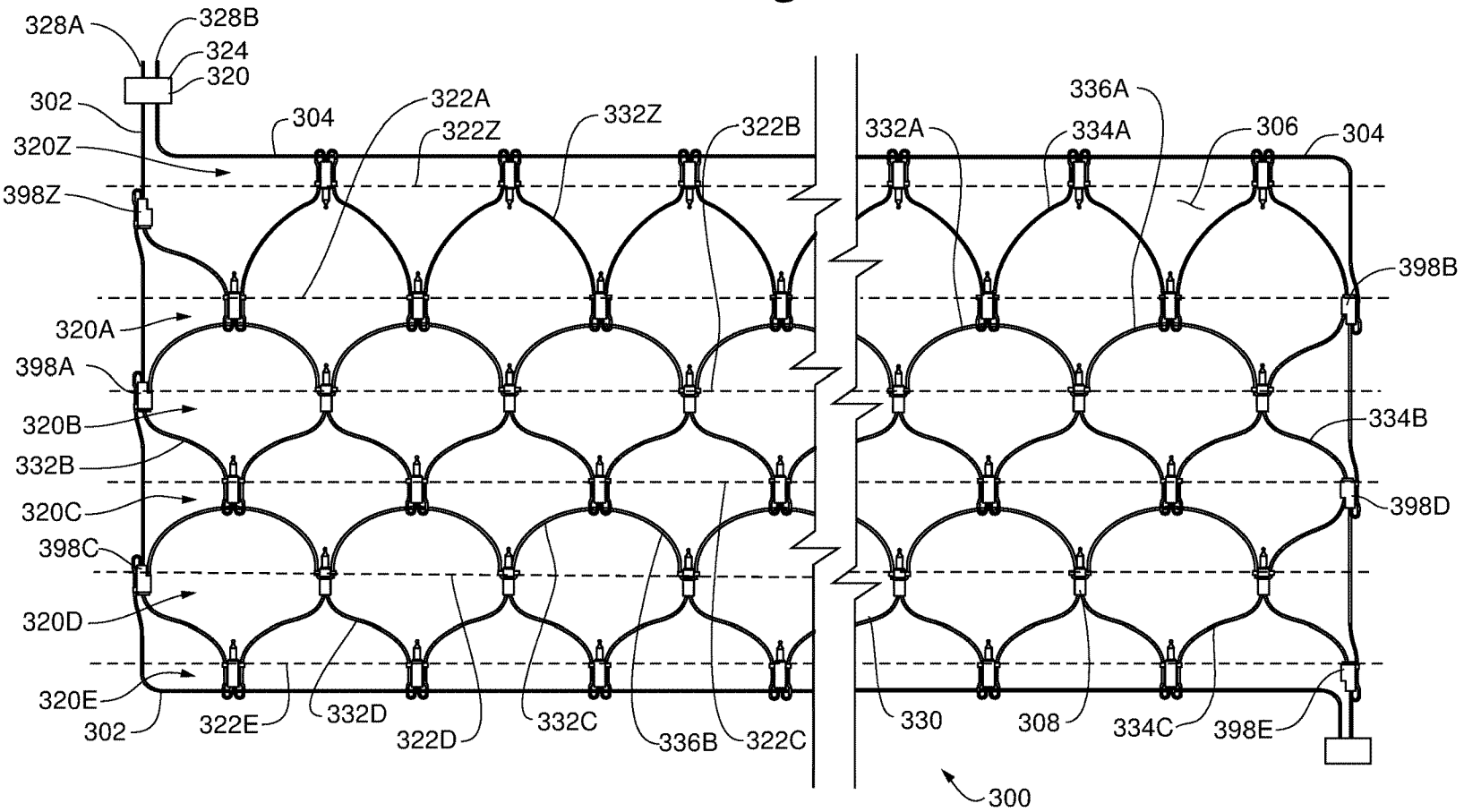
FIG. 14 is a plan view showing an additional illustrative embodiment of decorative lighting assembly 300 shown in FIGS. 11-13.

FIG. 14 is a plan view showing an additional illustrative embodiment of decorative lighting assembly 300 shown in the previous figure. Decorative lighting assembly 300 comprises a first power wire 302 and a second power wire 304. In FIG. 14, first power wire 302 and second power wire 304 are cooperating to surround a display area 306 of decorative lighting assembly 300. With reference to FIG. 14 it will be appreciated that decorative lighting assembly 300 includes a plurality of lamp assemblies 308 distributed across display area 306. The plurality of lamp assemblies 308 include a zeroth row 320Z of lamp assemblies 308, a first row 320A of lamp assemblies 308, a second row 320B of lamp assemblies 308, a third row 320C of lamp assemblies 308, a fourth row 320 of lamp assemblies 308, and a fifth row 320E of lamp assemblies 308.

In the embodiment of FIG. 14, a plurality of lamp assemblies 308 of decorative lighting assembly 300 are inter-connected by intermediate wires 330 to form electrical circuits. Also in the embodiment of FIG. 14, a plurality of lamp assemblies 308 of decorative lighting assembly 300 are mechanically coupled by cords 336 which provide mechanical support. In the embodiment of FIG. 14, the wires and the cords cooperate to form a net-like structure.

In the embodiment of FIG. 14, a plurality of intermediate wires 330 are disposed along a zeroth zig-zag path 332Z connecting the lamp assemblies 308 in the zeroth row 320Z with the lamp assemblies 308 in the first row 320A. A first cord 336A is disposed along a first zig-zag path 332A mechanically coupling the lamp assemblies 308 in the first row 320A with the lamp assemblies 308 in the second row 320B in the embodiment of FIG. 14. Also in the embodiment of FIG. 14, a plurality of intermediate wires 330 are disposed along a second zig-zag path 332B connecting the lamp assemblies 308 in the second row 320B with the lamp assemblies 308 in the third row 320C.

A second cord 336B is disposed along a third zig-zag path 332C mechanically coupling the lamp assemblies 308 in the third row 320C with the lamp assemblies in the fourth row 320D in the embodiment of FIG. 14. A plurality of intermediate wires 330 disposed along a fourth zig-zag path 332D connecting the lamp assemblies 308 in the fourth row 320D with the lamp assemblies 308 in the fifth row 320E in the embodiment of FIG. 14.

Decorative lighting assembly 300 of FIG. 14, includes a first series circuit 334A comprising a plurality of lamp assemblies 308 and intermediate wires 330 connected between the first power wire 304 and second power wire 306. In the embodiment of FIG. 14, the first series circuit 334A includes a plurality of intermediate wires 330 disposed along a zeroth zig-zag path 332Z connecting the lamp assemblies 308 in the zeroth row 320Z with the lamp assemblies 308 in the first row 320A. In the embodiment of FIG. 14, a zeroth connector 398Z electrically connects a first end of the first series circuit 334A to the first power wire 304 and a second connector 398B electrically connects a second end of the first series circuit 334A to the second power wire 306.

Decorative lighting assembly 300 of FIG. 14, also includes a second series circuit 334B comprising a plurality of lamp assemblies 308 and intermediate wires 330 connected between the first power wire 304 and second power wire 306. A third series circuit 334C of decorative lighting assembly 300 can also be seen in FIG. 14. The third series circuit 334C comprises a plurality of lamp assemblies 308 and intermediate wires 330 connected between the first power wire 304 and second power wire 306.

In the embodiment of FIG. 14, the second series circuit 334B includes a plurality of intermediate wires 330 disposed along the second zig-zag path 332B connecting the lamp assemblies 308 in the second row 320B with the lamp assemblies 308 in the third row 320C. In the embodiment of FIG. 14, the third series circuit 334C includes a plurality of intermediate wires 330 disposed along the fourth zig-zag path 332D connecting the lamp assemblies 308 in the fourth row 320D with the lamp assemblies 308 in the fifth row 320E. In the embodiment of FIG. 13, a first connector 398A electrically connects a first end of the second series circuit 334B to the first power wire 304 and a fourth connector 398D electrically connects a second end of the second series circuit 334B to the second power wire 306. In the embodiment of FIG. 13, a third connector 398C electrically connects a first end of the third series circuit 334B to the first power wire 304 and a fifth connector 398E electrically connects a second end of the third series circuit 334B to the second power wire 306.

Figure 15:
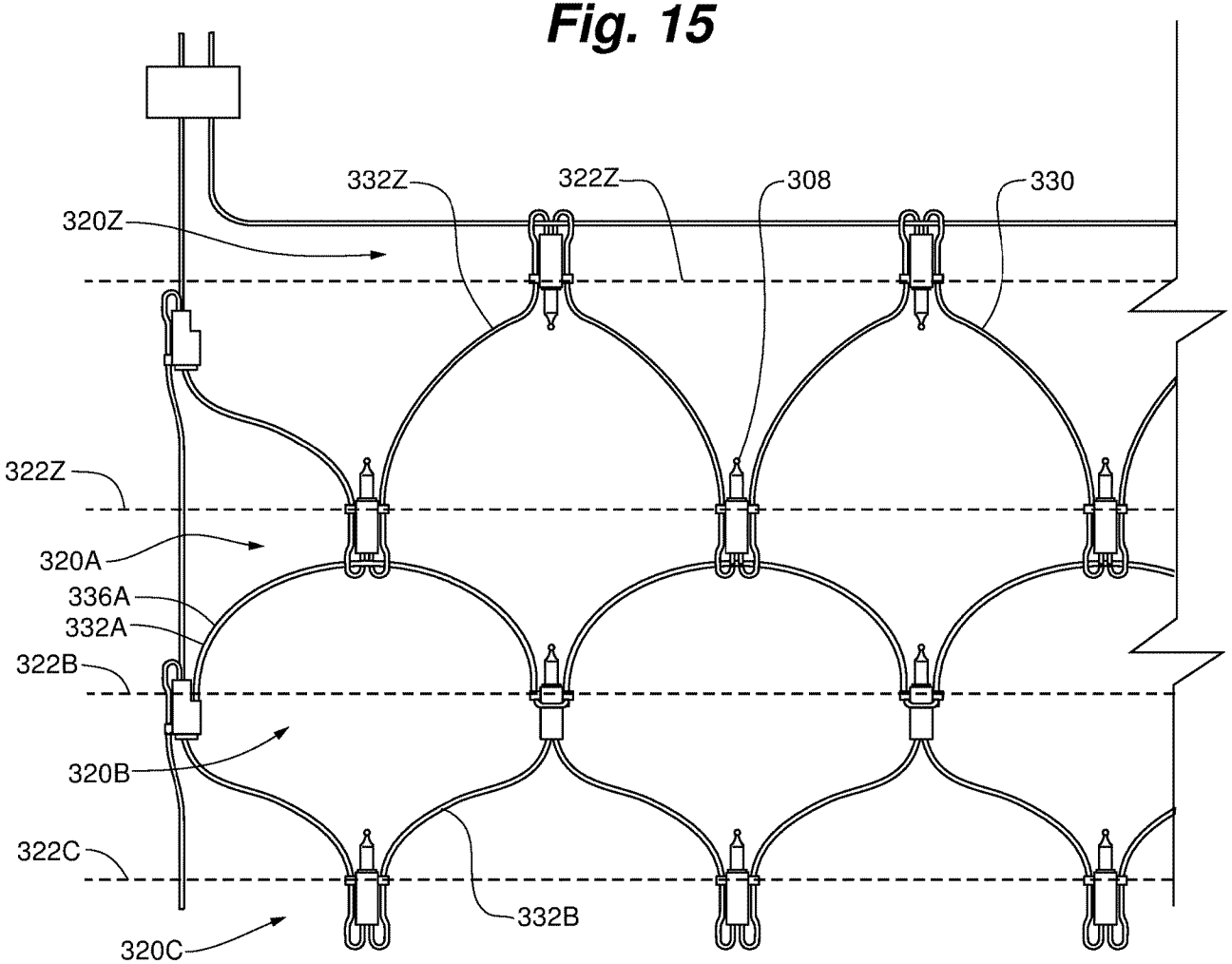
FIG. 15 is an enlarged plan view showing a portion of the decorative lighting assembly shown in FIG. 14.

FIG. 15 is an enlarged plan view showing a portion of the decorative lighting assembly 300 shown in the previous figure. The portion of decorative lighting assembly 300 shown in FIG. 15 includes a zeroth row 320Z of lamp assemblies 308, a first row 320A of lamp assemblies 308, a second row 320B of lamp assemblies 308 and a third row 320C of lamp assemblies 308. In the embodiment of FIG. 15, a plurality of intermediate wires 330 are disposed along a zeroth zig-zag path 332Z connecting the lamp assemblies 308 in the zeroth row 320Z with the lamp assemblies 308 in the first row 320A. A first cord 336A is disposed along a first zig-zag path 332A mechanically coupling the lamp assemblies 308 in the first row 320A with the lamp assemblies 308 in the second row 320B in the embodiment of FIG. 15. Also in the embodiment of FIG. 15, a plurality of intermediate wires 330 are disposed along a second zig-zag path 332B connecting the lamp assemblies 308 in the second row 320B with the lamp assemblies 308 in the third row 320C.

With reference to FIG. 15, it will be appreciated that a first loop of wire is fixed to each of the lamp assemblies 308 in the first row 320A. A second loop of wire is also fixed to each of the lamp assemblies 308 in the first row 320A. In FIG. 15, the first cord 336A can be seen extending through the first and second loops of wire fixed to each of the lamp assemblies 308 in the second row first row 320A.

Figure 16:
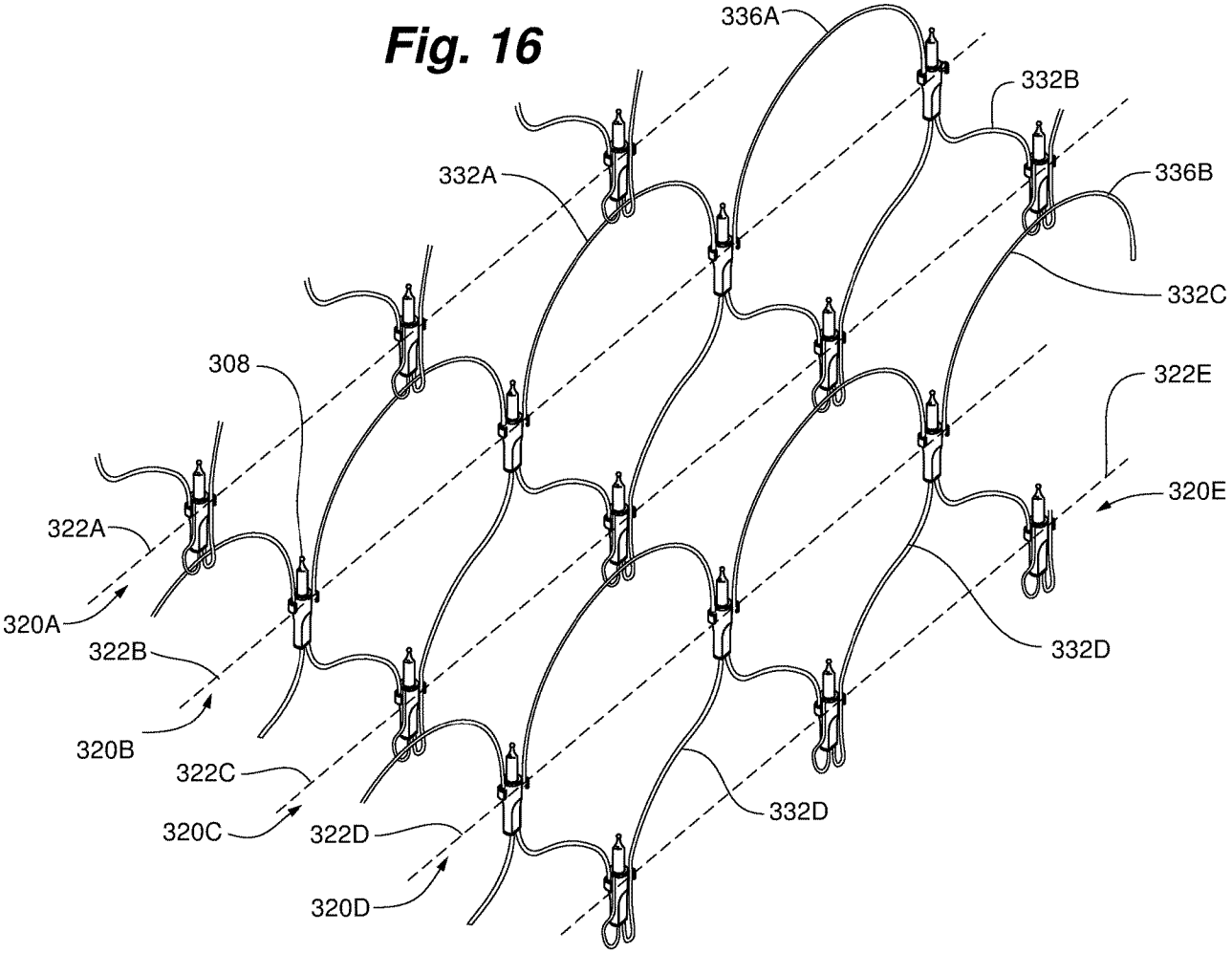
FIG. 16 is an enlarged perspective view further illustrating a portion of a decorative lighting assembly.

FIG. 16 is an enlarged perspective view further illustrating a portion of a decorative lighting assembly 300. The portion of decorative lighting assembly 300 shown in FIG. 16 includes a plurality of lamp assemblies 308 distributed across a display area 306. The plurality of lamp assemblies 308 include a first row 320A of lamp assemblies 308 aligned along a first line 322A, a second row 320B of lamp assemblies 308 aligned along a second line 322B, a third row 320C of lamp assemblies 308 aligned along a third line 322C, and a fourth row 320D of lamp assemblies 308 aligned along a fourth line 322D.

In the embodiment of FIG. 16, a plurality of intermediate wires 330 are disposed along a zeroth zig-zag path 332Z connecting the lamp assemblies 308 in the zeroth row 320Z with the lamp assemblies 308 in the first row 320A. A first cord 336A is disposed along a first zig-zag path 332A mechanically coupling the lamp assemblies 308 in the first row 320A with the lamp assemblies 308 in the second row 320B in the embodiment of FIG. 16. Also in the embodiment of FIG. 16, a plurality of intermediate wires 330 are disposed along a second zig-zag path 332B connecting the lamp assemblies 308 in the second row 320B with the lamp assemblies 308 in the third row 320C.

A second cord 336B is disposed along a third zig-zag path 332C mechanically coupling the lamp assemblies 308 in the third row 320C with the lamp assemblies in the fourth row 320D in the embodiment of FIG. 16. A plurality of intermediate wires 330 disposed along a fourth zig-zag path 332D connecting the lamp assemblies 308 in the fourth row 320D with the lamp assemblies 308 in the fifth row 320E in the embodiment of FIG. 16.

Figure 17B:
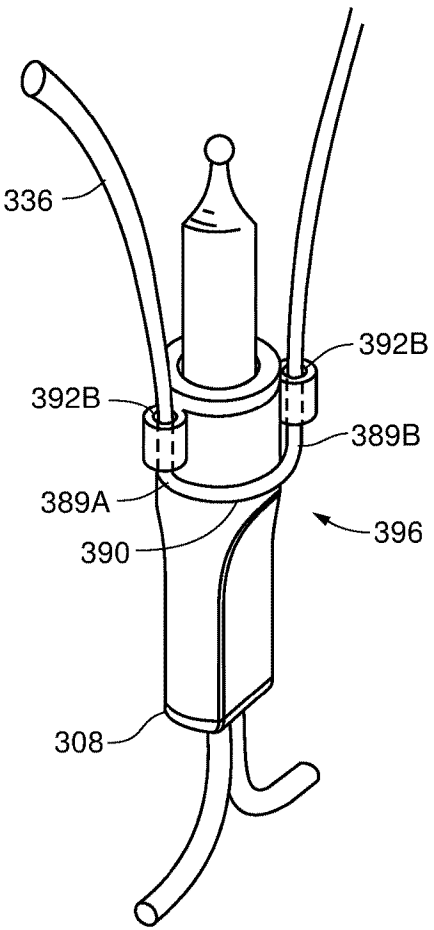
FIG. 17B is a perspective view showing another side of the lamp assembly shown in FIG. 17A.
Figure 17A:
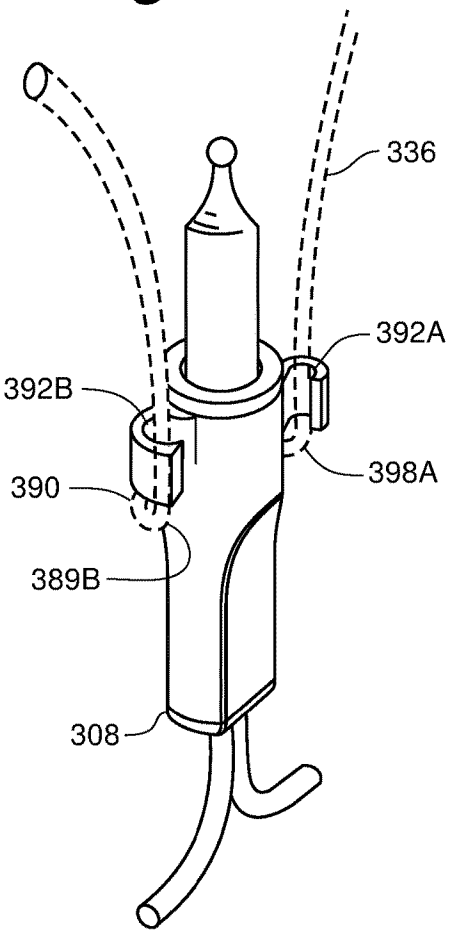
FIG. 17A is a perspective view showing one side of a lamp assembly.

FIG. 17A is a perspective view showing one side of a lamp assembly 308. FIG. 17B is a perspective view showing another side of the lamp assembly 308 shown in FIG. 17A. FIG. 17A and FIG. 17B may be collectively referred to as FIG. 17. A connection 396 is formed between the lamp assembly 308 and a cord 336. In the embodiment of FIG. 17, the connection 396 comprises a portion of the cord 336 that is extending through a tortuous path 394 defined by the lamp assembly 308. A portion of the cord 336 extends through a first lumen 392A and a second lumen 392B defined by the housing of the lamp assembly 308. A bight 390 of the cord 336 extends along the outside surface of the housing between the first lumen 392A and the second lumen 392B. A first bend 389A is formed in the cord 336 between the first lumen 392A and the bight 390. A second bend 389B is formed in the cord 336 between the second lumen 392B and the bight 390.

Figure 18B:
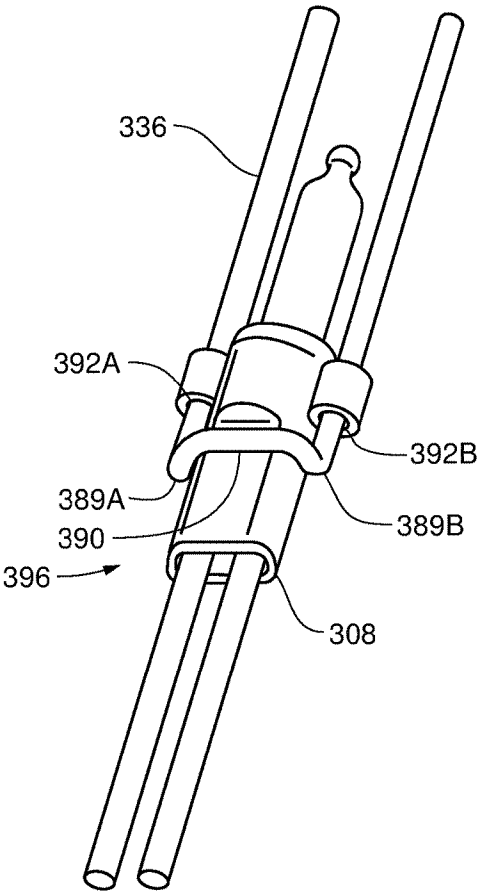
FIG. 18B is a perspective view showing another side of the lamp assembly shown in FIG. 18A.
Figure 18A:
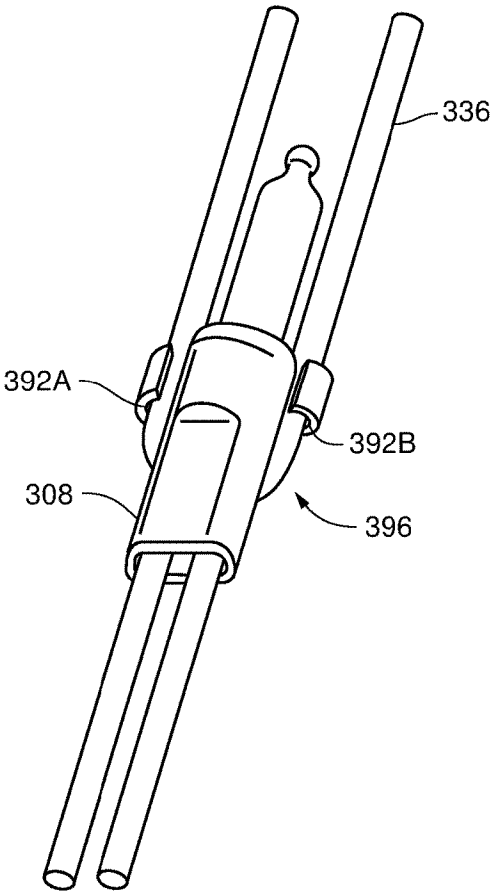
FIG. 18A is a perspective view showing one side of a lamp assembly.

FIG. 18A is a perspective view showing one side of a lamp assembly 308. FIG. 18B is a perspective view showing another side of the lamp assembly 308 shown in FIG. 18A. FIG. 18A and FIG. 18B may be collectively referred to as FIG. 18. A connection 396 is formed between the lamp assembly 308 and a cord 336. In the embodiment of FIG. 18, the connection 396 comprises a portion of the cord 336 that is extending through a tortuous path 394 defined by the lamp assembly 308. A portion of the cord 336 extends through a first lumen 392A and a second lumen 392B defined by the housing of the lamp assembly 308. A bight 390 of the cord 336 extends along the outside surface of the housing between the first lumen 392A and the second lumen 392B. A first bend 389A is formed in the cord 336 between the first lumen 392A and the bight 390. A second bend 389B is formed in the cord 336 between the second lumen 392B and the bight 390.

As described above, embodiments of the disclosure include a number of decorative lighting assemblies that are tangle resistant and easier to manufacture as compared to known decorative lighting structures.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

What is claimed is:

1. A decorative lighting assembly, comprising:

a first power wire electrically connected to a first power contact;

a second power wire electrically connected to a second power contact;

the first power wire and the second power wire cooperating to surround a display area of the decorative lighting assembly;

a plurality of lamp assemblies distributed across the display area, the plurality of lamp assemblies including a first row of lamp assemblies aligned along a first line, a second row of lamp assemblies aligned along a second line, a third row of lamp assemblies aligned along a third line, and a fourth row of lamp assemblies aligned along a fourth line;

a first cord portion disposed along a first zig-zag path mechanically coupling the lamp assemblies in the first row with the lamp assemblies in the second row, a portion of the first cord portion extending through a first lumen defined by a first lamp holder of each lamp assembly in the first row and another portion of the first cord portion extending through a second lumen defined by a second lamp holder in the second row, a bight of the portion of the first cord extending along outer surfaces of the first and second lamp holders;

a plurality of intermediate wires disposed along a second zig-zag path mechanically coupling and electrically connecting the lamp assemblies in the second row with the lamp assemblies in the third row; and a second cord portion disposed along a third zig-zag path mechanically coupling the lamp assemblies in the third row with the lamp assemblies in the fourth row.

2. The decorative lighting assembly of claim 1, wherein a shape of the display area generally corresponds to a rectangle having a first long side, a second long side, a first short side, and a second short side, the first power wire defines the first short side and the first long side of the rectangle; the second power wire defines the second short side and the second long side of the rectangle; and the first cord portion extends along the first zig-zag path between the first short side of the rectangle and the second short side of the rectangle.

3. The decorative lighting assembly of claim 2, further comprising a first connector that mechanically couples a first end of a cord to the first power wire and a second connector that mechanically couples a second end of the cord to the second power wire, the first fastener being located on the first short side defined by the first power wire and the second fastener being located on the second short side defined by the second power wire.

4. The decorative lighting assembly of claim 3, wherein the first connector forms an electrical connection between two portions of the first power wire and the second connector forms an electrical connection between two portions of the second power wire.

5. The decorative lighting assembly of claim 1, wherein the first power wire and the second power wire comprise reinforced wire.

6. The decorative lighting assembly of claim 5, wherein the intermediate wires comprise reinforced wire, the reinforced wire having an internal reinforcing strand.

7. The decorative lighting assembly of claim 5, wherein the reinforced wire comprises:

a longitudinally-extending reinforcing strand, the reinforcing strand comprising one or more fibers comprising a polymer material;

a plurality of conductor strands wound about the reinforcing strand; and an outer insulating layer adjacent to, and covering, one or more of the conductor strands.

8. The decorative lighting assembly of claim 1, wherein:

the first power wire comprises 18 AWG wire;

the second power wire comprises 18 AWG wire; and the intermediate wires comprise 22 AWG wire.

9. The decorative lighting assembly of claim 1, wherein the intermediate wires comprise 22 or 25 AWG reinforced wire, the reinforced wire having an internal reinforcing strand.

10. The decorative lighting assembly of claim 2, wherein a first series circuit of the decorative lighting assembly comprises:

a first lamp assembly electrically connected to the first power wire;

an nth lamp assembly connected to the second power wire; and a plurality of intermediate lamp assemblies electrically connected in series between the first lamp assembly and the nth lamp assembly.

11. The decorative lighting assembly of claim 10, further comprising a first connector electrically connecting a first end of the series circuit to the first power wire and a second connector electrically connecting a second end of the series circuit to the second power wire, and wherein the second connector mechanically couples one end of a cord to the second power wire, the first connector being located on the first short side defined by the first power wire and the second connector being located on the second short side defined by the second power wire.

12. The decorative lighting assembly of claim 11, wherein the first series circuit follows a winding path between the first connector and the second connector so that the lamp assemblies are distributed across a portion of the display area, wherein the winding path of the first series circuit comprises the plurality of intermediate wires disposed along the first zig-zag path connecting the lamp assemblies in the first row with the lamp assemblies in the second row and at least one cord extends between pairs of lamp assemblies that are adjacent to one another physically and are not adjacent to one another in the first series circuit.

13. The decorative lighting assembly of claim 1, wherein the at least one cord forms a connection with each of the lamp assemblies in the second row, each connection comprising a portion of the at least one cord extending through a loop, the loop comprising a segment of one of the plurality of intermediate wires.

14. A decorative lighting assembly, comprising:

a first power wire electrically connected to a first power contact;

a second power wire electrically connected to a second power contact;

the first power wire and the second power wire cooperating to surround a display area of the decorative lighting assembly;

a plurality of lamp assemblies distributed across the display area, the plurality of lamp assemblies including a first row of lamp assemblies aligned along a first line, a second row of lamp assemblies aligned along a second line, a third row of lamp assemblies aligned along a third line, and a fourth row of lamp assemblies aligned along a fourth line;

a first cord disposed along a first zig-zag path mechanically coupling the lamp assemblies in the first row with the lamp assemblies in the second row;

a plurality of intermediate wires disposed along a second zig-zag path mechanically coupling and electrically connecting the lamp assemblies in the second row with the lamp assemblies in the third row;

a second cord disposed along a third zig-zag path mechanically coupling the lamp assemblies in the third row with the lamp assemblies in the fourth row;

wherein the at least one cord forms a connection with each of the lamp assemblies in the second row, each connection comprising a tortuous path defined by each lamp assembly and a portion of the at least one cord extending through the tortuous path and wherein the portion of the at least one cord extends through a first eye defined by a lamp holder of each lamp assembly and a second eye defined by a lamp holder of each lamp assembly, a bight of the portion of the at least one cord extends along an outer surface of the lamp holder between the first eye and the second eye, and wherein the portion of the at least one cord includes a first bend disposed between the first eye and the bight.

15. A decorative lighting assembly, comprising:

a first power wire electrically connected to a first power contact;

a second power wire electrically connected to a second power contact;

the first power wire and the second power wire cooperating to surround a display area of the decorative lighting assembly, such that the first power wire extends along a first side, a second side and a fourth side of the display area, and the second power wire extends along a third side of the display area;

a plurality of lamp assemblies distributed across the display area, the plurality of lamp assemblies including a first column of lamp assemblies aligned along a first line, a second column of lamp assemblies aligned along a second line, a third column of lamp assemblies aligned along a third line, and a fourth column of lamp assemblies aligned along a fourth line;

a first plurality of intermediate wires disposed along a first zig-zag path connecting the lamp assemblies in the first column with the lamp assemblies in the second column;

at least one cord disposed along a second zig-zag path connecting the lamp assemblies in the second column with the lamp assemblies in the third column, a portion of the at least one cord extending through a first lumen defined by a lamp holder of each lamp assembly in the second column; and a second plurality of intermediate wires disposed along a third zig-zag path connecting the lamp assemblies in the third column with the lamp assemblies in the fourth column.

16. The decorative lighting assembly of claim 15, wherein the shape of the display area generally corresponds to a rectangle having a first long side, a second long side, a first short side, and a second short side, the first power wire defines the first short side, the first long side, and the second short side of the rectangle; and the second power wire defines the second long side of the rectangle; and the at least one cord extends along the second zig-zag path between the first long side and the second long side.

17. The decorative lighting assembly of claim 16, further comprising a fifth column of lamp assemblies aligned along a fifth line, wherein the at least one cord is disposed along a fourth zig-zag path connecting the lamp assemblies in the fourth column with the lamp assemblies in the fifth column, wherein the at least one cord comprises a single cord that extends through both the second zig-zag path and the fourth zig-zag path.

18. The decorative lighting assembly of claim 17, further comprising a first fastener that mechanically couples a first end of the single cord and a second end of the single cord to the first power wire, the first fastener being located on the first long side of the rectangle.

19. The decorative lighting assembly of claim 18, wherein the first power wire extends through a passageway defined by the first fastener.

20. The decorative lighting assembly of claim 17, further comprising a bushing that mechanically couples an intermediate portion of the single cord to the second power wire and wherein the single cord and the second power wire extend through a passageway defined by the bushing, the bushing defining groove, the groove allowing the intermediate portion of the single cord and the second power wire to pass therethrough into the passageway.

21. The decorative lighting assembly of claim 15, wherein the first power wire and the second power wire comprise reinforced wire, the reinforced wire having an internal reinforcing strand.

22. The decorative lighting assembly of claim 15, wherein the first plurality of intermediate wires comprises reinforced wire and the second plurality of intermediate wires comprises reinforced wire.

23. The decorative lighting assembly of claim 22, wherein the reinforced wire comprises:

a longitudinally-extending reinforcing strand, the reinforcing strand comprising one or more fibers comprising a polymer material;

a plurality of conductor strands wound about the reinforcing strand; and an outer insulating layer adjacent to, and covering, one or more of the conductor strands.

24. The decorative lighting assembly of claim 15, wherein:

the first power wire comprises 18 AWG wire;

the second power wire comprises 18 AWG wire; and the first plurality of intermediate wires and the second plurality of intermediate wires comprise 22 or 25 AWG wire.

25. The decorative lighting assembly of claim 15, wherein:

each of the first plurality of intermediate wires and the second plurality of intermediate wires has a first outer diameter;

the at least one cord has a second outer diameter; and the second outer diameter is substantially equal to the first outer diameter so that the decorative lighting assembly has a uniform appearance, and wherein:

each of the first plurality of intermediate wires and the second plurality of intermediate wires comprises a plurality of conductor strands and an outer insulating layer adjacent to, and covering, one or more of the conductor strands;

the at least one cord comprises a solid strand; and the insulating layer of each of the first plurality of intermediate wires and the second plurality of intermediate wires and the solid strand comprise the same material so that the decorative lighting assembly has a uniform appearance.

26. The decorative lighting assembly of claim 16, wherein a first series circuit of the decorative lighting assembly comprises:

a first lamp assembly electrically connected to the first power wire;

an nth lamp assembly connected to the second power wire; and a plurality of intermediate lamp assemblies electrically connected in series between the first lamp assembly and the nth lamp assembly.

27. The decorative lighting assembly of claim 26, further comprising a first connector electrically connecting a first end of the series circuit to the first power wire and a second connector electrically connecting a second end of the series circuit to the second power wire, the first connector being located on the first long side defined by the first power wire and the second connector being located on the second long side defined by the second power wire.

28. The decorative lighting assembly of claim 26, wherein the second connector mechanically couples one end of a third cord to the second power wire.

29. The decorative lighting assembly of claim 28, wherein the first series circuit follows a winding path between the first connector and the second connector so that the lamp assemblies are distributed across the display area.

30. The decorative lighting assembly of claim 29, wherein the winding path of the first series circuit includes:

the first plurality of intermediate wires disposed along the first zig-zag path connecting the lamp assemblies in the first column with the lamp assemblies in the second column; and the second plurality of intermediate wires disposed along the third zig-zag path connecting the lamp assemblies in the third column with the lamp assemblies in the fourth column.

31. The decorative lighting assembly of claim 1, wherein the first lumen is defined by a first connecting element of the lamp holder and the second lumen is defined by a second connecting element of the lamp holder, each connecting element extending beyond the outer surface of the lamp holder.

32. The decorative lighting assembly of claim 15, wherein the first lumen is defined by a first connecting element of the lamp holder, the first connecting element extending beyond an outer surface of a housing of the lamp holder.

33. A decorative lighting assembly, comprising:

a first power wire electrically connected to a first power contact;

a second power wire electrically connected to a second power contact;

the first power wire and the second power wire cooperating to surround a display area of the decorative lighting assembly, such that the first power wire extends along a first side and a second side of the display area, and the second power wire extends along a third side and a fourth side of the display area;

a plurality of lamp assemblies distributed across the display area, the plurality of lamp assemblies including a first column of lamp assemblies aligned along a first line, a second column of lamp assemblies aligned along a second line, a third column of lamp assemblies aligned along a third line, and a fourth column of lamp assemblies aligned along a fourth line;

a first plurality of intermediate wires disposed along a first zig-zag path connecting the lamp assemblies in the first column with the lamp assemblies in the second column;

at least one cord disposed along a second zig-zag path connecting the lamp assemblies in the second column with the lamp assemblies in the third column, a portion of the at least one cord extending through a first lumen defined by a lamp holder of each lamp assembly in the second column; and a second plurality of intermediate wires disposed along a third zig-zag path connecting the lamp assemblies in the third column with the lamp assemblies in the fourth column.

* * * * *